US009551948B2

(12) United States Patent
Harashima et al.

(10) Patent No.: US 9,551,948 B2
(45) Date of Patent: Jan. 24, 2017

(54) IMAGE FORMING APPARATUS FIXING OF TONER CONTAINING FLAT PARTICLES

(71) Applicant: FUJI XEROX CO., LTD., Minato-ku, Tokyo (JP)

(72) Inventors: Yasumitsu Harashima, Kanagawa (JP); Toko Hara, Kanagawa (JP); Yutaka Kiuchi, Kanagawa (JP); Miho Ikeda, Kanagawa (JP); Takaharu Nakajima, Kanagawa (JP); Koichiro Yuasa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/107,525

(22) Filed: Dec. 16, 2013

(65) Prior Publication Data

US 2014/0356008 A1 Dec. 4, 2014

(30) Foreign Application Priority Data

Jun. 3, 2013 (JP) ..... 2013-117270

(51) Int. Cl.
*G03G 15/20* (2006.01)
*G03G 13/20* (2006.01)
*G03G 15/00* (2006.01)

(52) U.S. Cl.
CPC ..... *G03G 13/20* (2013.01); *G03G 15/2039* (2013.01); *G03G 15/6585* (2013.01); *G03G 2215/0125* (2013.01)

(58) Field of Classification Search
CPC ..... G03G 15/2039; G03G 15/6585
USPC ..... 399/69
See application file for complete search history.

(56) References Cited

U.S. PATENT DOCUMENTS

| | | | |
|---|---|---|---|
| 6,326,115 | B1 * | 12/2001 | Nakanishi et al. |
| 2004/0037573 | A1 * | 2/2004 | Hirota et al. |
| 2007/0065179 | A1 * | 3/2007 | Fujita |
| 2009/0148199 | A1 * | 6/2009 | Gotoda |
| 2009/0238616 | A1 * | 9/2009 | Ciaschi |
| 2011/0221807 | A1 * | 9/2011 | Yoshida |
| 2011/0222927 | A1 * | 9/2011 | Yamashina |
| 2011/0262858 | A1 * | 10/2011 | Nair et al. |
| 2012/0107738 | A1 * | 5/2012 | Argoitia |
| 2014/0029966 | A1 * | 1/2014 | Kojiri |

FOREIGN PATENT DOCUMENTS

| | | | |
|---|---|---|---|
| JP | 11305553 | A * | 11/1999 |
| JP | 2004-029194 | A | 1/2004 |
| JP | 2004029563 | A * | 1/2004 |
| JP | 2006317633 | A * | 11/2006 |

* cited by examiner

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

An image forming apparatus includes: a first image forming section that uses a toner containing flat pigment particles; a second image forming section that uses a toner not containing the flat pigment particles; and a fixing section that fixes an image formed on a recording medium to the recording medium using heat. The quantity of heat that the fixing section applies to the image is increased in the case where the image formed on the recording medium using the toner containing the flat pigment particles is to be fixed compared to a case where the image formed on the recording medium using the toner not containing the flat pigment particles is to be fixed.

2 Claims, 18 Drawing Sheets

IMAGE FORMING APPARATUS FIXING OF TONER CONTAINING FLAT PARTICLES

CROSS-REFERENCE TO RELATED APPLICATIONS

This application is based on and claims priority under 35 USC 119 from Japanese Patent Application No. 2013-117270 filed Jun. 3, 2013.

BACKGROUND

Technical Field

The present invention relates to an image forming apparatus.

SUMMARY

According to an aspect of the present invention, there is provided an image forming apparatus including: a first image forming section that uses a toner containing flat pigment particles; a second image forming section that uses a toner not containing the flat pigment particles; and a fixing section that fixes an image formed on a recording medium to the recording medium using heat, in which a quantity of heat that the fixing section applies to the image is increased in the case where the image formed on the recording medium using the toner containing the flat pigment particles is to be fixed compared to a case where the image formed on the recording medium using the toner not containing the flat pigment particles is to be fixed.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1A:
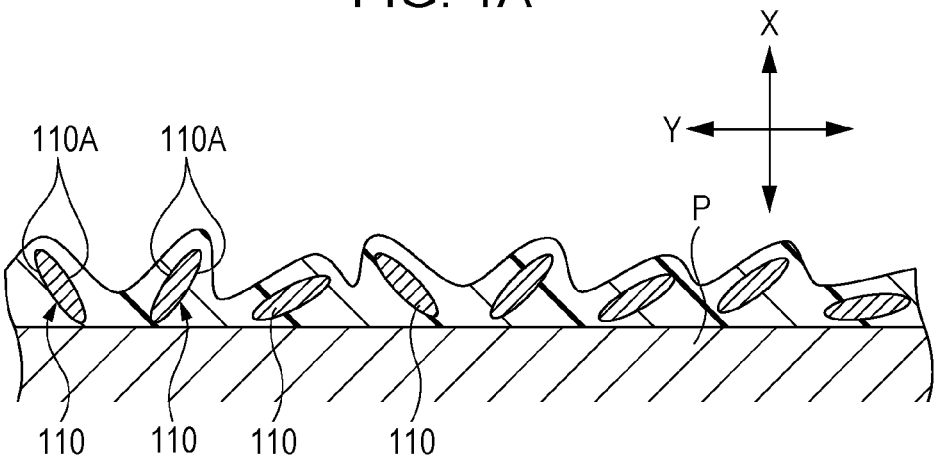
FIGS. 1A and 1B are each a cross-sectional view illustrating the posture of flat pigment particles contained in a toner image formed by an image forming apparatus according to a first exemplary embodiment of the present invention, illustrated together with that according to a comparative example.

An image forming apparatus according to an exemplary embodiment of the present invention will be described with reference to FIGS. 1 to 8. In the drawings, the arrow H indicates the vertical direction, and the arrow W indicates the horizontal direction corresponding to the apparatus width direction.

<Overall Configuration of Image Forming Apparatus>

Figure 8:
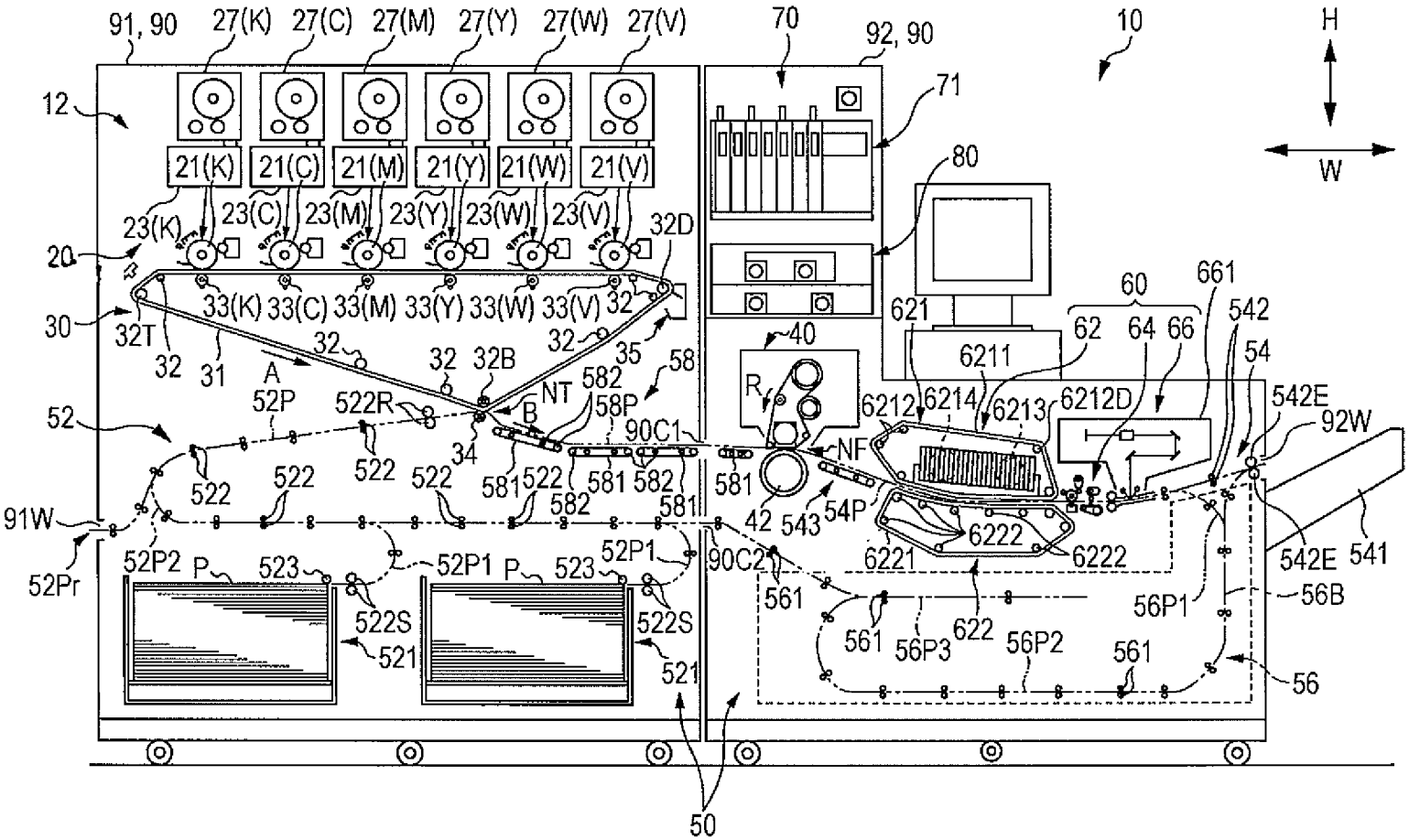
FIG. 8 illustrates a schematic configuration of the image forming apparatus according to the first exemplary embodiment of the present invention.

FIG. 8 is a schematic diagram illustrating an overall configuration of an image forming apparatus 10 as seen from the front side. As illustrated in the drawing, the image forming apparatus 10 includes an image forming section 12 that forms an image on a sheet member P that serves as a recording medium through an electrophotographic system, a medium transport device 50 that transports the sheet member P, and a post-processing section 60 that performs post-processing etc. on the sheet member P on which an image has been formed.

The image forming apparatus 10 also includes a controller 70 that controls the various sections discussed earlier and a power source section 80 to be discussed later, and the power source section 80 which supplies power to the various sections described above including the controller 70.

The image forming section 12 includes a toner image forming section 20 that forms a toner image, a transfer device 30 that transfers the toner image formed by the toner image forming section 20 to the sheet member P, and a fixing device 40 that fixes the toner image transferred to the sheet member P to the sheet member P.

The medium transport device 50 includes a medium supply section 52 that supplies the sheet member P to the image forming section 12, and a medium ejection section 54 that ejects the sheet member P on which the toner image has been formed. The medium transport device 50 also includes a medium return section 56 used to form an image on both surfaces of the sheet member P, and an intermediate transport section 58 to be discussed later.

The post-processing section 60 includes a medium cooling section 62 that cools the sheet member P to which the toner image has been transferred in the image forming section 12, a correction device 64 that corrects curl of the sheet member P, and an image inspection section 66 that inspects the image formed on the sheet member P. The various sections forming the post-processing section 60 are disposed in the medium ejection section 54 of the medium transport device 50.

The various sections of the image forming apparatus 10 are housed in a housing 90 except for an ejected medium receiving section 541 forming the medium ejection section 54 of the medium transport device 50. In the exemplary embodiment, the housing 90 is dividable into a first housing 91 and a second housing 92 that are adjacent to each other in the apparatus width direction. This reduces the transport size of the image forming apparatus 10 in the apparatus width direction.

The first housing 91 houses a principal portion of the image forming section 12 excluding the fixing device 40 to be discussed later, and the medium supply section 52. The second housing 92 houses the fixing device 40 forming the image forming section 12, the medium ejection section 54 excluding the ejected medium receiving section 541, the medium cooling section 62, the image inspection section 66, the medium return section 56, the controller 70, and the power source section 80. The first housing 91 and the second housing 92 are coupled to each other by a fastening unit such as a bolt and a nut (not illustrated), for example. With the first housing 91 and the second housing 92 coupled to each other, a communication opening portion 90C1 for the sheet member P that extends from a transfer nip NT to a fixing nip NF of the image forming section 12 to be discussed later and a communication passage 90C2 for the sheet member P that extends from the medium return section 56 to the medium supply section 52 are formed between the first housing 91 and the second housing 92.

(Image Forming Section)

As discussed earlier, the image forming section 12 includes the toner image forming section 20, the transfer device 30, and the fixing device 40. Plural toner image forming sections 20 are provided to form toner images in respective colors. In the exemplary embodiment, toner image forming sections 20 for six colors, namely a first special color (V), a second special color (W), yellow (Y), magenta (M), cyan (C), and black (K), are provided. The symbols (V), (W), (Y), (M), (C), and (K) used in FIG. 8 indicate the respective colors described above. The transfer device 30 transfers toner images in the six colors from a transfer belt 31, to which the toner images in the six colors superimposed on each other have been transferred through a first transfer, to the sheet member P at the transfer nip NT (as discussed in detail later).

In the exemplary embodiment, for example, the first special color (V) is a silver color for which a toner containing flat pigment particles is used to impart a metallic luster to an image. Meanwhile, the second special color (W) is a corporate color specific to a user that is used frequently compared to the other colors. The details of the silver toner and control performed on the various portions by the controller 70 to form an image using the silver toner will be discussed later.

[Toner Image Forming Section]

Figure 6:
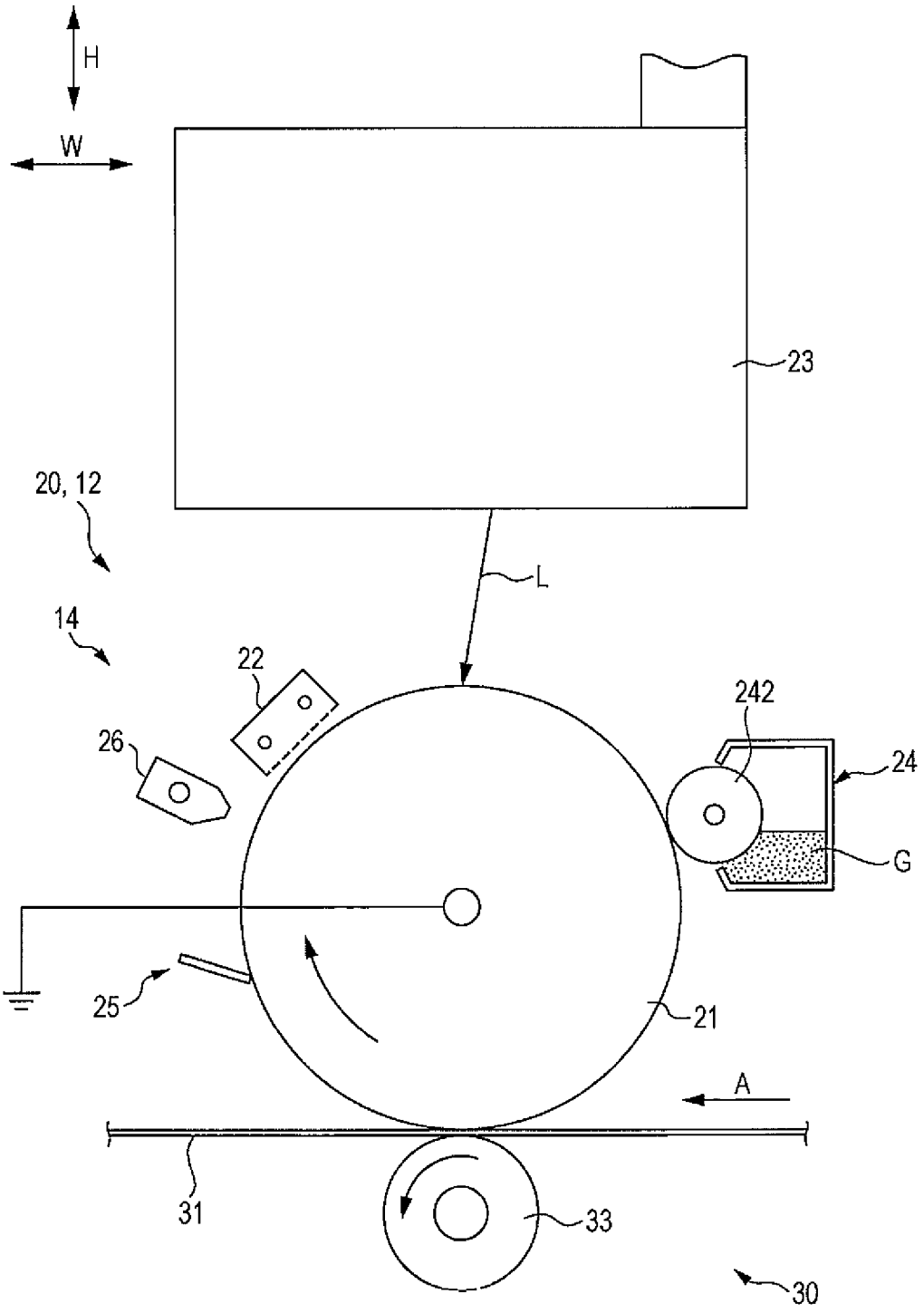
FIG. 6 illustrates the configuration of a toner image forming section provided in the image forming apparatus according to the first exemplary embodiment of the present invention.

The toner image forming sections 20 for the respective colors are basically formed in the same manner except for the toners to be used. Thus, image forming units 14 for the respective colors will be described below without being specifically differentiated from each other. As illustrated in FIG. 6, the image forming unit 14 of the toner image forming section 20 includes a photosensitive drum 21 that serves as an example of an image holding element, a charging unit 22, an exposure device 23, a developing device 24 that serves as an example of a developing unit, a cleaning device 25, and a static eliminating device 26.

[Photosensitive Drum]

The photosensitive drum 21 is formed in a cylindrical shape, grounded, and driven by a drive unit (not illustrated) so as to rotate about its own axis. A photosensitive layer that provides a negative charging polarity, for example, is formed on the surface of the photosensitive drum 21. As illustrated in FIG. 8, the photosensitive drums 21 for the respective colors are disposed in line with each other along the apparatus width direction as seen from the front.

[Charging Unit]

As illustrated in FIG. 6, the charging unit 22 charges the surface (photosensitive layer) of the photosensitive drum 21 to a negative polarity. In the exemplary embodiment, the charging unit 22 is a scorotron charging unit of a corona discharge type (non-contact charging type).

[Exposure Device]

The exposure device 23 forms an electrostatic latent image on the surface of the photosensitive drum 21. Specifically, the exposure device 23 radiates modulated exposure light L to the surface of the photosensitive drum 21, which has been charged by the charging unit 22, in accordance with image data received from an image signal processing section 71 (see FIG. 8) that forms the controller 70. An electrostatic latent image is formed on the surface of the photosensitive drum 21 by the exposure light L radiated by the exposure device 23.

[Developing Device]

The developing device 24 develops the electrostatic latent image formed on the surface of the photosensitive drum 21 using a developer G containing a toner to form a toner image on the surface of the photosensitive drum 21.

The developing device 24 is supplied with the toner from a toner cartridge 27 that stores the toner.

[Cleaning Device]

The cleaning device 25 is formed as a blade that scrapes off a toner that remains on the surface of the photosensitive drum 21 after the toner image is transferred to the transfer device 30 from the surface of the photosensitive drum 21.

[Static Eliminating Device]

The static eliminating device 26 eliminates static by radiating light to the photosensitive drum 21 after the transfer. This causes the charging history of the surface of the photosensitive drum 21 to be canceled.

[Transfer Device]

The transfer device 30 performs a first transfer of the toner images on the photosensitive drums 21 for the respective colors onto the transfer belt 31 as superimposed on each other, and performs a second transfer of the superimposed toner images onto the sheet member P. The transfer device 30 will be specifically described below.

[Transfer Belt]

Figure 7:
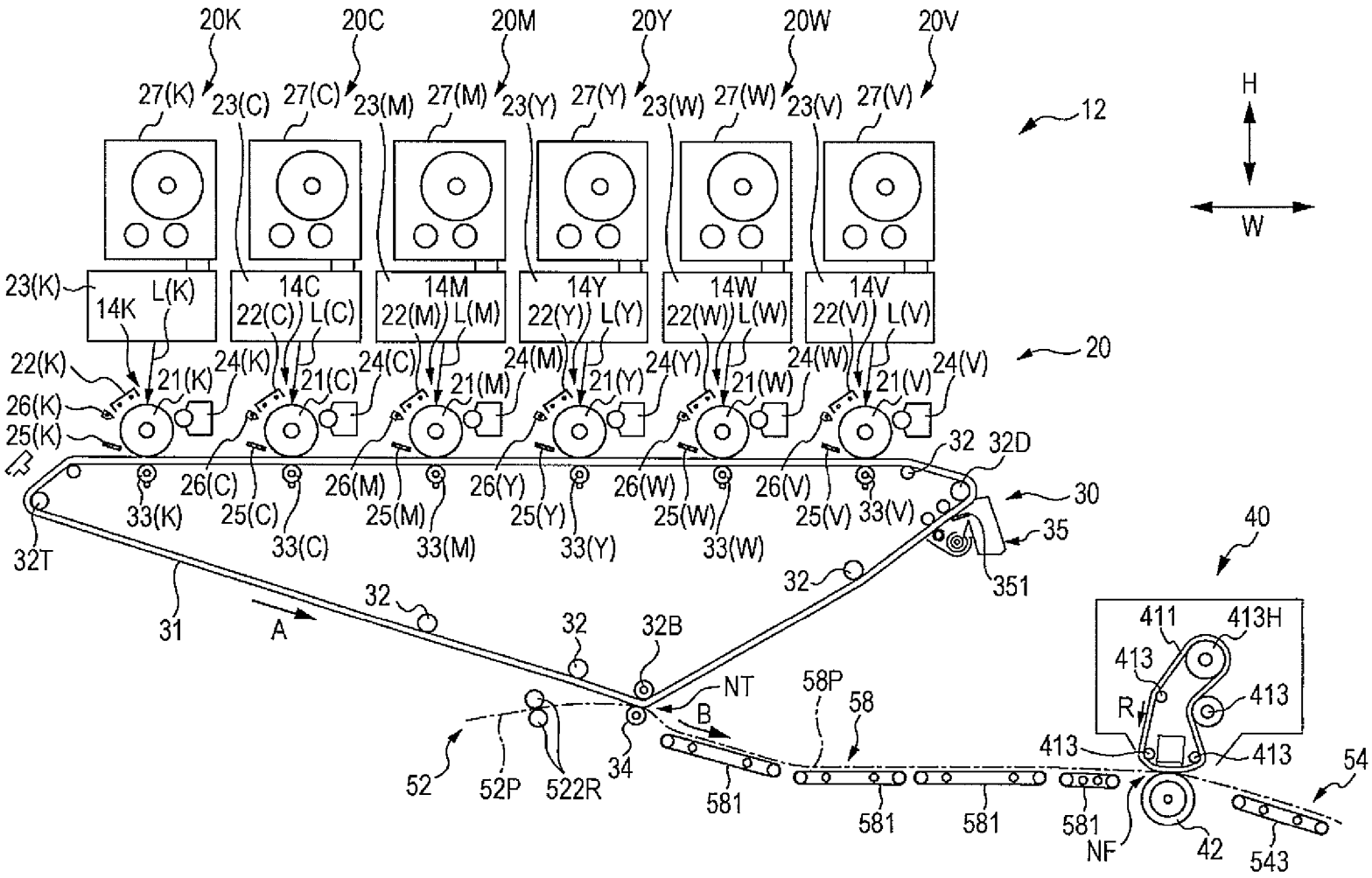
FIG. 7 illustrates the configuration of an image forming section provided in the image forming apparatus according to the first exemplary embodiment of the present invention.

As illustrated in FIG. 7, the transfer belt 31 has an endless shape, and is wound around plural rollers 32 to determine its posture. In the exemplary embodiment, the transfer belt 31 has a posture of an inverted obtuse triangle that is long in the apparatus width direction as seen from the front. Of the plural rollers 32, a roller 32D illustrated in FIG. 7 functions as a drive roller that applies power of a motor (not illustrated) to circulate the transfer belt 31 in the direction of the arrow A.

Of the plural rollers 32, a roller 32T illustrated in FIG. 7 functions as a tension applying roller that applies a tension to the transfer belt 31. Of the plural rollers 32, a roller 32B illustrated in FIG. 7 functions as a counter roller for a second transfer roller 34 to be discussed later. The lower-end vertex of the transfer belt 31, which forms the obtuse angle of the fixing belt 31 in the posture of an inverted obtuse triangle as discussed earlier, is wound around the roller 32B. The upper side of the transfer belt 31 which extends in the apparatus width direction with the transfer belt 31 in the posture discussed earlier contacts the photosensitive drums 21 for the respective colors from below.

[First Transfer Roller]

First transfer rollers 33 that serve as examples of a transfer member that transfers the toner image on each photosensitive drum 21 to the transfer belt 31 are disposed inside the transfer belt 31. The first transfer rollers 33 are disposed opposite to the photosensitive drums 21 for the corresponding colors across the transfer belt 31. The first transfer rollers 33 are applied with a transfer bias voltage that is opposite in polarity to the toner polarity. Application of the transfer bias voltage causes the toner images formed on the photosensitive drums 21 to be transferred to the transfer belt 31.

[Second Transfer Roller]

The transfer device 30 also includes the second transfer roller 34 which transfers the superimposed toner images on the transfer belt 31 to the sheet member P. The second transfer roller 34 is disposed with the transfer belt 31 interposed between the roller 32B and the second transfer roller 34 to form the transfer nip NT between the transfer belt 31 and the second transfer roller 34. The sheet member P is supplied to the transfer nip NT from the medium supply section 52 at an appropriate timing. The second transfer roller 34 is applied with a transfer bias voltage that is opposite in polarity to the toner polarity by a power supply section (not illustrated). Application of the transfer bias voltage causes the toner images to be transferred from the transfer belt 31 to the sheet member P which passes through the transfer nip NT.

[Cleaning Device]

The transfer device 30 further includes the cleaning device 35 which cleans the transfer belt 31 after the second transfer. The cleaning device 35 is disposed downstream of the location at which the second transfer is performed (the transfer nip NT) and upstream of the location at which the first transfer is performed in the direction of circulation of the transfer belt 31. The cleaning device 35 includes a blade 351 that scrapes off a toner that remains on the surface of the transfer belt 31 from the surface of the transfer belt 31.

[Fixing Device: Overview]

The fixing device 40 fixes the toner images transferred to the sheet member P in the transfer device 30 to the sheet member P. In the exemplary embodiment, the fixing device 40 is configurated to fix the toner images to the sheet member P by heating and pressurizing the toner images at the fixing nip NF formed by a fixing belt 411 wound around plural rollers 413 and a pressurizing roller 42. A roller 413H serves as a heating roller that includes a built-in heater, for example, and that is rotated by a drive force transmitted from a motor (not illustrated). This causes the fixing belt 411 to be circulated in the direction of the arrow R.

The pressurizing roller 42 is also rotated by a drive force transmitted from a motor (not illustrated) at a peripheral velocity that is generally the same as the peripheral velocity of the fixing belt 411. The fixing temperature, the fixing pressure, the fixing time, and so forth of the fixing device 40 controlled by the controller 70 will be discussed in detail later.

(Medium Transport Device)

As illustrated in FIG. 8, the medium transport device 50 includes the medium supply section 52, the medium ejection section 54, the medium return section 56, and the intermediate transport section 58.

[Medium Supply Section]

The medium supply section 52 includes a container 521 that stores the sheet members P stacked on each other. In the exemplary embodiment, two containers 521 are disposed side by side along the apparatus width direction below the transfer device 30.

A medium supply passage 52P is formed by plural transport roller pairs 522, guides (not illustrated), and so forth to extend from each container 521 to the transfer nip NT as the second transfer position. The medium supply passage 52P is turned back in the apparatus width direction at two turning portions 52P1 and 52P2 while being raised to form a shape that leads to the transfer nip NT (a generally "S" shape).

A feed roller 523 that feeds the uppermost one of the sheet members P stored in the container 521 is disposed on the upper side of each container 521. Of the plural transport roller pairs 522, a transport roller pair 522S on the most upstream side in the transport direction of the sheet member P functions as separation rollers that separate the sheet members P fed from the container 521 by the feed roller 523 in a superposed state from each other. Of the plural transport roller pairs 522, a transport roller pair 522R positioned immediately upstream of the transfer nip NT in the transport direction of the sheet member P operates such that the timing of movement of the toner images on the transfer belt 31 and the timing of transport of the sheet member P match each other.

The medium supply section 52 includes a preliminary transport passage 52Pr. The preliminary transport passage 52Pr starts at an opening portion 91W of the first housing 91 provided opposite to the second housing 92 to be merged with the turning portion 52P2 of the medium supply passage 52P. The preliminary transport passage 52Pr serves as a transport passage that feeds the sheet member P fed from an optional recording medium supply device (not illustrated) disposed adjacent to the opening portion 91W of the first housing 91 to the image forming section 12.

[Intermediate Transport Section]

As illustrated in FIG. 7, the intermediate transport section 58 is disposed to extend from the transfer nip NT of the transfer device 30 to the fixing nip NF of the fixing device 40, and includes plural belt transport members 581 that each include an endless transport belt wound around rollers 582.

The intermediate transport section 58 transports the sheet member P along path 58P by circulating the transport belt with the transport members 581 suctioning air (to generate a negative pressure) to draw the sheet member P to the surface of the transport belt.

[Medium Ejection Section]

As illustrated in FIG. 8, the medium ejection section 54 ejects the sheet member P to which the toner images have been fixed by the fixing device 40 of the image forming section 12 to the outside of the housing 90 from an ejection port 92W formed at an end portion of the second housing 92 opposite to the first housing 91.

The medium ejection section 54 includes an ejected medium receiving section 541 that receives the sheet member P ejected from the ejection port 92W.

The medium ejection section 54 has a medium ejection passage 54P through which the sheet member P is transported from the fixing device 40 (the fixing nip NF) to the ejection port 92W. The medium ejection passage 54P is formed from a belt transport member 543, plural roller pairs 542, guides (not illustrated), and so forth. Of the plural roller pairs 542, a roller pair 542E disposed on the most downstream side in the ejection direction of the sheet member P functions as ejection rollers that eject the sheet member P onto the ejected medium receiving section 541.

[Medium Return Section]

The medium return section 56 includes plural roller pairs 561. The plural roller pairs 561 form a reverse passage 56B to which the sheet member P having passed through the image inspection section 66 is fed in the case where there is a request to form an image on both surfaces of the sheet member P. The reversal passage 56P has a branch path 56P1, a transport path 56P2, and a reverse path 56P3. The branch path 56P1 is branched from the medium ejection passage 54P. The transport path 56P2 feeds the sheet member P received from the branch path 56P1 to the medium supply passage 52P. The reverse path 56P3 is provided in the middle of the transport path 56P2, and reverses the front and back sides of the sheet member P by changing the transport direction of the sheet member P transported through the transport path 56P2 into the opposite direction (through switchback transport).

(Post-Processing Section)

The medium cooling section 62, the correction device 64, and the image inspection section 66 which form the post-processing section 60 are disposed on a portion of the medium ejection passage 54P of the medium ejection section 54 provided upstream of the branch portion of the branch path 56P1 in the ejection direction of the sheet member P, and arranged sequentially in the order in which they are mentioned from the upstream side in the ejection direction.

[Medium Cooling Section]

The medium cooling section 62 includes a heat absorbing device 621 that absorbs heat of the sheet member P, and a pressing device 622 that presses the sheet member P against the heat absorbing device 621. The heat absorbing device 621 is disposed on the upper side of the medium ejection passage 54P. The pressing device 622 is disposed on the lower side of the medium ejection passage 54P.

The heat absorbing device 621 includes an endless heat absorbing belt 6211, plural rollers 6212 that support the heat absorbing belt 6211, a heat sink 6213 disposed on the inner side of the heat absorbing belt 6211, and a fan 6214 that cools the heat sink 6213.

The outer peripheral surface of the heat absorbing belt 6211 contacts the sheet member P so as to be able to exchange heat with the sheet member P. Of the plural rollers 6212, a roller 6212D functions as a drive roller that transmits a drive force to the heat absorbing belt 6211. The heat sink 6213 makes slidable surface contact with the inner peripheral surface of the heat absorbing belt 6211 over a predetermined range along the medium ejection passage 54P.

The pressing device 622 includes an endless pressing belt 6221, and plural rollers 6222 that support the pressing belt 6221. The pressing belt 6221 is wound around the plural rollers 6222. The pressing device 622 transports the sheet member P together with the heat absorbing belt 6211 while pressing the sheet member P against the heat absorbing belt 6211 (the heat sink 6213).

[Correction Device]

The correction device 64 is provided downstream of the medium cooling section 62 in the medium ejection section 54. The correction device 64 corrects curl of the sheet member P received from the medium cooling section 62.

[Image Inspection Section]

An in-line sensor 661 that forms a principal portion of the image inspection section 66 is disposed downstream of the correction device 64 in the medium ejection section 54. The in-line sensor 661 detects the presence or absence of, and the degree of, a defect in toner concentration, an image defect, a defect in image position, and so forth of the fixed toner image on the basis of light radiated to the sheet member P and reflected from the sheet member P.

<Image Forming Operation (Effect) of Image Forming Apparatus>

Next, an overview of an image forming process and a post-processing process performed on the sheet member P by the image forming apparatus 10 will be described.

As illustrated in FIG. 8, when an image forming instruction is received, the controller 70 actuates the toner image forming section 20, the transfer device 30, and the fixing device 40. This rotates the photosensitive drum 21 of the image forming unit 14 and a developing roller 242 of the developing device 24 for each color to circulate the transfer belt 31 as illustrated in FIG. 7. This also rotates the pressurizing roller 42 to circulate the fixing belt 411. In synchronization with these operations, the controller 70 further actuates the medium transport device 50 and so forth.

This causes the photosensitive drum 21 for each color to be charged by the charging unit 22 while being rotated. The controller 70 sends image data which have been subjected to image processing performed by the image signal processing section to each exposure device 23. The exposure device 23 outputs exposure light L in accordance with the image data to expose the charged photosensitive drum 21 to the light. Then, an electrostatic latent image is formed on the surface of the photosensitive drum 21. The electrostatic latent image formed on the photosensitive drum 21 is developed using a developer supplied from the developing device 24. Consequently, a toner image in the corresponding color among the first special color (V), the second special color (W), yellow (Y), magenta (M), cyan (C), and black (K) is formed on the photosensitive drum 21 for each color.

The toner images in the respective colors formed on the photosensitive drums 21 for the respective colors are sequentially transferred to the circulating transfer belt 31 by applying a transfer bias voltage through the first transfer rollers 33 for the respective colors. This causes a superimposed toner image obtained by superimposing the toner images in the six colors to be formed on the transfer belt 31. The superimposed toner image is transported to the transfer nip NT by the circulation of the transfer belt 31.

As illustrated in FIG. 8, the sheet member P is supplied to the transfer nip NT by the transport roller pair 522R of the medium supply section 52 at a timing that matches the transport of the superimposed toner image. Application of the transfer bias voltage at the transfer nip NT causes the superimposed toner image to be transferred from the transfer belt 31 to the sheet member P.

The sheet member P to which the toner image has been transferred is transported by the intermediate transport section 58 from the transfer nip NT of the transfer device 30 to the fixing nip NF of the fixing device 40. The fixing device 40 applies heat and a pressure to the sheet member P passing through the fixing nip NF. This causes the transferred toner image to be fixed to the sheet member P.

The sheet member P ejected from the fixing device 40 is processed by the post-processing section 60 while being transported by the medium ejection section 54 to the ejected medium receiving section 541 outside the apparatus. The sheet member P heated in the fixing process is first cooled in the medium cooling section 62. Then, the sheet member P is corrected for its curl by the correction device 64. The image inspection section 66 detects the presence or absence of, and the degree of, a defect in toner concentration, an image defect, a defect in image position, and so forth of the toner image fixed to the sheet member P. The sheet member P is ejected to the medium ejection section 54.

Meanwhile, in the case where an image is to be formed on a non-image surface of the sheet member P on which no image is formed (in the case of double-sided printing), the controller 70 switches the transport passage for the sheet member P after passing through the image inspection section 66 from the medium ejection passage 54P of the medium ejection section 54 to the branch path 56P1 of the medium return section 56. This causes the sheet member P to be fed to the medium supply passage 52P with its front and back sides reversed by way of the reverse passage 56P. An image is formed (fixed) on the back surface of the sheet member P in the same process as the image forming process performed on the front surface discussed earlier. The sheet member P is ejected by the medium ejection section 54 to the ejected medium receiving section 541 outside the apparatus through the same process as the process performed after an image is formed on the front surface discussed earlier.

<Configuration of Principal Portion>

Next, the silver toner used for the first special color (V) and control performed on the fixing device 40 by the controller 70 to form an image using the silver toner will be described.

(Toner)

Figure 1B:
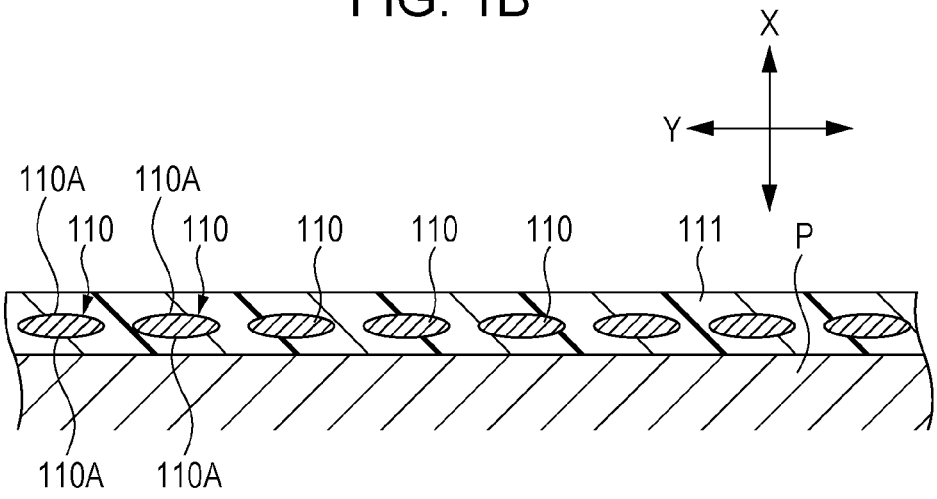

As illustrated in FIG. 1B, the silver toner used for the first special color (V) contains pigment particles 110 that serve as examples of flat pigment particles, and a binder resin 111, and is used to impart a metallic luster to an image. Examples of the image imparted with a metallic luster include an image formed using the silver toner and toners in colors other than the silver color, and an image formed using only the silver toner.

The pigment particles 110 are made of aluminum. As illustrated in FIG. 3B, the pigment particles 110 are shaped such that, when placed on a flat surface and seen from a side, their dimension in the horizontal direction in the drawing is larger than their dimension in the vertical direction in the drawing.

Figure 3A:
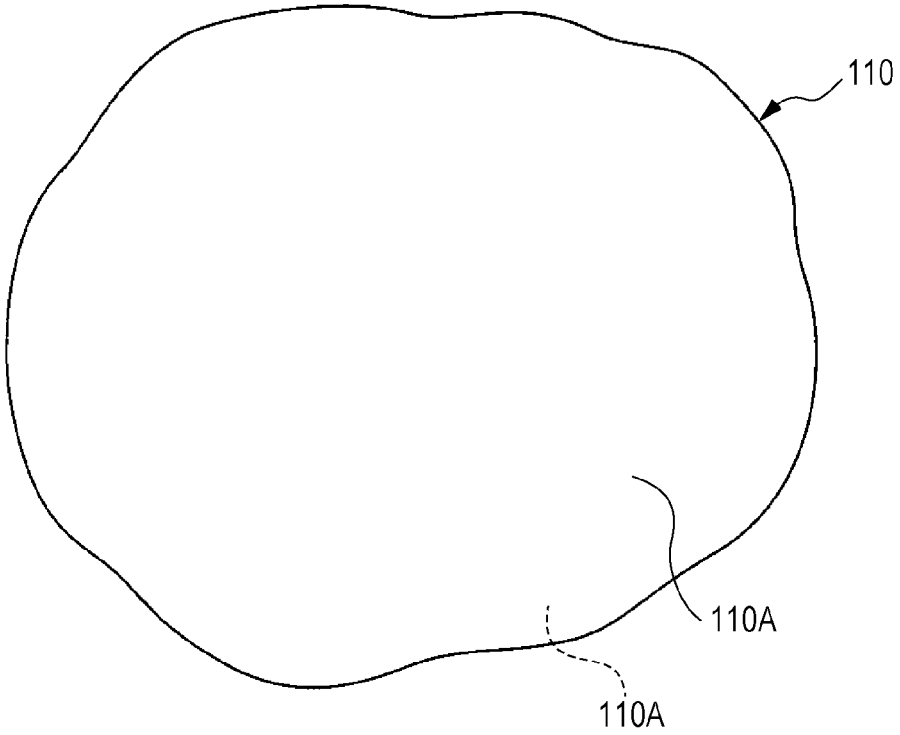
FIGS. 3A and 3B are a plan view and a side view, respectively, of a flat pigment particle contained in a toner used by the image forming apparatus according to the first exemplary embodiment of the present invention.
Figure 3B:
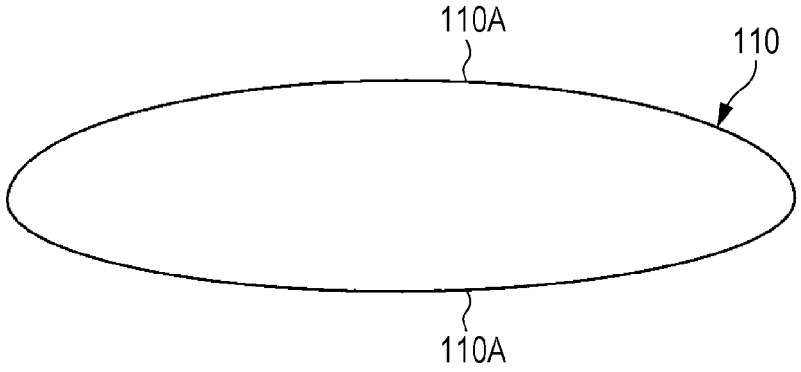

When the pigment particle 110 illustrated in FIG. 3B is seen from the upper side in the drawing, the pigment particle 110 has a more spread shape as illustrated in FIG. 3A than its shape as seen from a side. The pigment particle 110 has a pair of reflective surfaces 110A (flat surfaces) that face upward and downward with the pigment particle 110 placed on a flat surface (see FIG. 3B). Consequently, the pigment particles 110 have a flat shape.

On the other hand, toners in colors other than the silver color (hereinafter referred to simply as "toners in the other colors") that are used for the second special color (W), yellow (Y), magenta (M), cyan (C), and black (K) contain pigment particles not containing flat pigment particles (for example, an organic pigment and an inorganic pigment) and a binder resin.

(Controller)

In the case where an image forming instruction is received to impart a metallic luster to at least a part of an image, the controller 70 causes a silver toner image forming section 20V (an example of a first image forming section) to operate in the same manner as the toner image forming sections 20 for the other colors (examples of a second image forming section). Other components of the controller 70 will be described along with the effect of the principal portion to be discussed later.

<Effect of Principal Portion>

Next, the effect of the principal portion will be described.

When an image forming instruction is received to impart a metallic luster to at least a part of an image, the controller 70 causes the silver toner image forming section 20V to operate in the same manner as the toner image forming sections 20 for the other colors as illustrated in FIG. 7.

Specifically, an electrostatic latent image corresponding to a portion of the image to which a metallic luster is to be imparted is formed on the surface of a photosensitive drum 21V. That is, in the case where a metallic luster is to be imparted to the entire surface of the sheet member P, an electrostatic latent image is formed on the entire surface of the photosensitive drum 21V. In the case where a metallic luster is to be imparted to a part of the surface of the sheet member P, an electrostatic latent image is formed on the corresponding portion of the surface of the photosensitive drum 21V.

The electrostatic latent image formed on the photosensitive drum 21V is developed using a developer containing a silver toner supplied from a developing device 24V. This causes a silver toner image to be formed on the photosensitive drum 21V.

The silver toner image is transferred to the circulating transfer belt 31, and the toner images in the other colors are sequentially transferred to the transfer belt 31 after the silver toner image is transferred to the transfer belt 31. This causes a superimposed toner image obtained by superimposing the toner images in the six colors to be formed on the transfer belt 31. The superimposed toner image (hereinafter referred to simply as a "toner image") is transferred from the transfer belt 31 to the sheet member P at the transfer nip NT.

The sheet member P to which the toner image has been transferred is transported by the intermediate transport section 58 from the transfer nip NT of the transfer device 30 to the fixing nip NF of the fixing device 40. The fixing device 40 applies heat and a pressure to the sheet member P passing through the fixing nip NF. This causes the transferred toner image to be fixed to the sheet member P.

The controller 70 controls the fixing device 40 so as to increase the quantity of heat to be applied to the image during fixation compared to a case where an image forming instruction is received not to impart a metallic luster to the image (in the case where the silver toner is not used). In other words, the controller 70 increases the quantity of heat to be applied to the toner image during fixation of the toner image formed on the sheet member P using a toner containing the pigment particles 110 compared to fixation of the toner image formed on the sheet member P without using a toner containing the pigment particles 110.

Specifically, the controller 70 increases the quantity of heat to be applied to the toner image during fixation by controlling the fixing device 40 so as to vary at least one of the fixing temperature, the fixing pressure, and the fixing time.

If a large quantity of heat is used to fix an image formed with a silver toner compared to an image formed with only toners in other colors, the image formed with the silver toner and the image formed with only the toners in the other colors may appear different after being fixed, which makes the image formed with the silver toner more remarkable.

<Evaluations>

Next, the flop index (FI) value of the image formed on the sheet member P using the silver toner is measured in accordance with ASTM E2194. The flop index value is an index that indicates a metallic luster, and a larger flop index value indicates an enhanced metallic luster.

[Evaluation 1]

1. OS coated paper W (manufactured by Fuji Xerox InterField Co., Ltd. and having a basis weight of 127 [g/m$^2$] and a smoothness measured in accordance with JISP 8119 of 4735 [Sec]) is used as the sheet member P.

2. Only the silver toner is used as the toner.

3. The peripheral velocity of the fixing belt 411 and the peripheral velocity of the pressurizing roller 42 (hereinafter referred to simply as a "fixing speed") are set to 160 [mm/s], 266 [mm/s], or 445 [mm/s], and an evaluation is performed for each fixing speed.

4. The temperature of the fixing belt 411 (hereinafter referred to as a "fixing temperature") is set to 155 [° C.] or 185 [° C.], and an evaluation is performed for each fixing temperature.

The fixation at a fixing speed of 445 [mm/s] and a fixing temperature of 155 [° C.] corresponds to an example of fixing conditions for a case where a metallic luster is not imparted to an image (hereinafter referred to simply as "standard fixing conditions"). The fixation at a fixing speed of 266 [mm/s] and a fixing temperature of 185 [° C.] corresponds to an example of fixing conditions for a case where a metallic luster is imparted to an image (hereinafter referred to simply as "luster fixing conditions").

Other conditions are the same among the evaluations.

[Result of Evaluation 1]

Figure 5A:
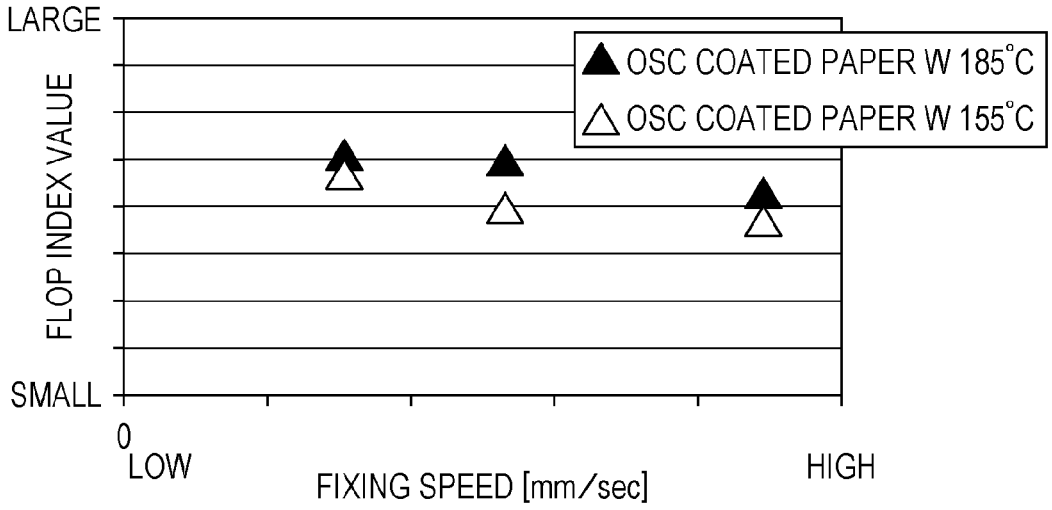
FIGS. 5A and 5B are each a graph illustrating the relationship between the flop index value and the fixing speed of the toner image formed by the image forming apparatus according to the first exemplary embodiment of the present invention, illustrated together with that according to a comparative example.

The result of Evaluation 1 is described using the graph of FIG. 5A.

In the graph of FIG. 5A, the horizontal axis indicates the fixing speed, and the vertical axis indicates the flop index value. In the graph, the white triangular symbols indicate the values at a fixing temperature of 155 [° C.], and the black triangular symbols indicate the values at a fixing temperature of 185 [° C.].

[Brief Summary of Evaluation 1]

It is seen from the graph that the flop index value is improved as the fixing speed is lower, and that the flop index value is improved as the fixing temperature is higher.

[Evaluation 2]

1. J paper (manufactured by Fuji Xerox InterField Co., Ltd. and having a basis weight of 82 [g/m$^2$] and a smoothness measured in accordance with JISP 8119 of 112 [Sec]) is used as the sheet member P.

2. Other conditions are the same as those in "Evaluation 1".

[Result of Evaluation 2]

Figure 5B:
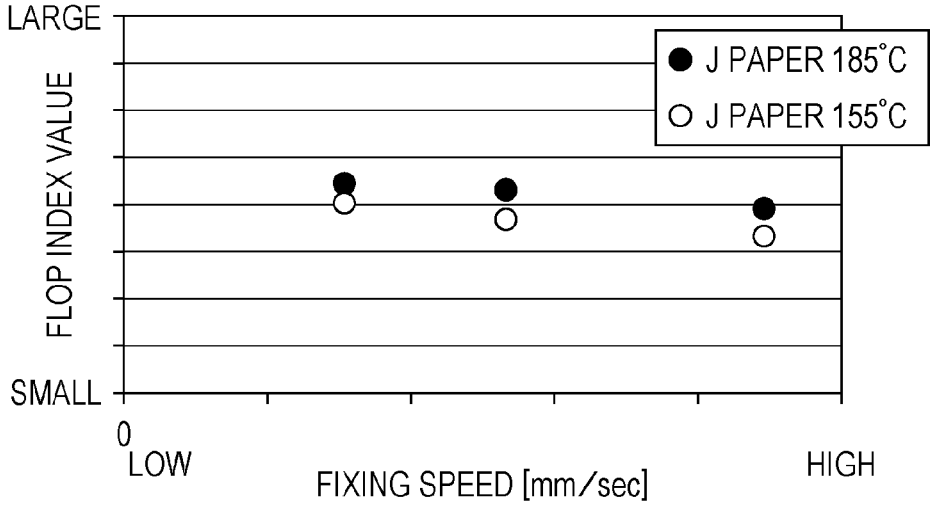

The result of Evaluation 2 is described using the graph of FIG. 5B.

In the graph of FIG. 5B, the horizontal axis indicates the fixing speed, and the vertical axis indicates the flop index value. In the graph, the white circular symbols indicate the values at a fixing temperature of 155 [° C.], and the black circular symbols indicate the values at a fixing temperature of 185 [° C.].

[Brief Summary of Evaluation 2]

It is seen from the graph that the flop index value is improved as the fixing speed is lower, and that the flop index value is improved as the fixing temperature is higher.

[Conclusion from Evaluations 1 and 2]

Figure 4:
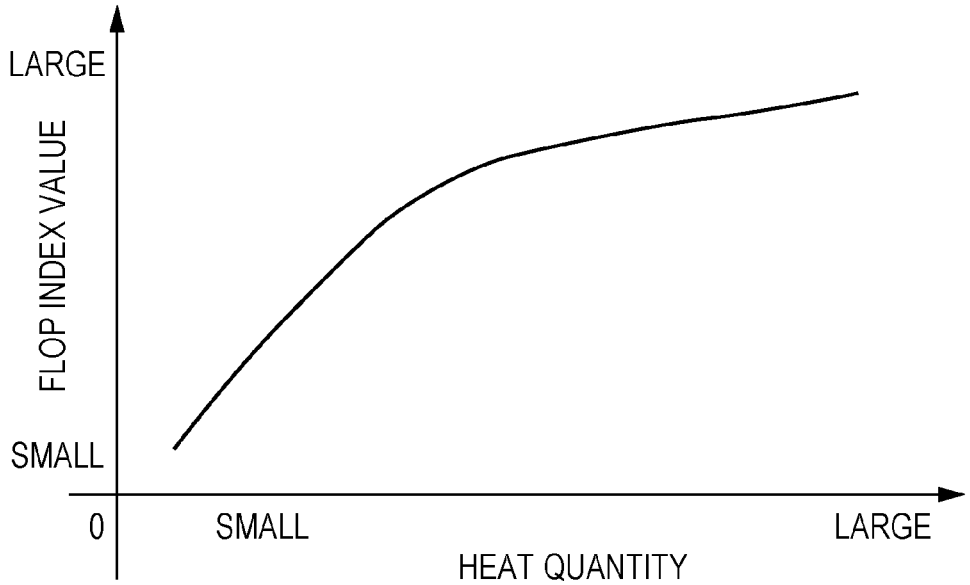
FIG. 4 is a graph illustrating the relationship between the flop index value and the quantity of heat during fixation of the toner image formed by the image forming apparatus according to the first exemplary embodiment of the present invention.

It is seen from Evaluations 1 and 2 that the flop index value is improved as the fixing speed is lower, and that the flop index value is improved as the fixing temperature is higher. That is, it is found that increasing the quantity of heat with which the toner image is fixed to the sheet member P improves the flop index value (enhances a metallic luster) compared to a case where the quantity of heat is small as illustrated in the graph of FIG. 4.

The reason that the flop index value is improved by increasing the quantity of heat with which the toner image is fixed to the sheet member P will be described below.

Increasing the quantity of heat with which the toner image is fixed to the sheet member P softens the binder resin forming the toner, which facilitates movement of the pigment particles 110 in a flat shape forming the toner. In this state, the toner image is pressurized toward the fixing belt 411 by the pressurizing roller 42. Thus, as illustrated in FIG. 1B, the reflective surfaces 110A of the pigment particles 110 face in the direction orthogonal to the sheet surface of the sheet member P (in the X direction in the drawing). The pigment particles 110 are arranged in the direction along the sheet surface of the sheet member P (in the Y direction in the drawing). As illustrated in FIG. 2B, the pigment particles 110 are distributed evenly on the sheet member P with the reflective surfaces 110A facing in the direction orthogonal to the sheet surface.

When the pigment particles 110 are arranged in the direction along the sheet surface with the reflective surfaces 110A facing in the direction orthogonal to the sheet surface as illustrated in FIG. 1B, diffusion of light reflected from the image is suppressed compared to a case where the reflective surfaces 110A of the pigment particles 110 do not face in a uniform direction as illustrated in FIG. 1A. This improves the flop index value.

Figure 2A:
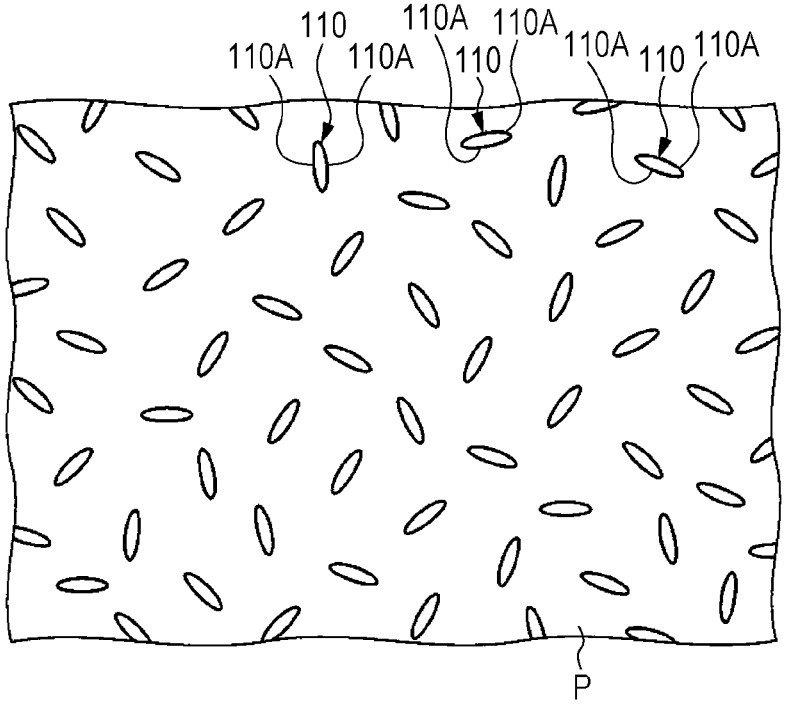
FIGS. 2A and 2B are each a plan view illustrating the posture of the flat pigment particles contained in the toner image formed by the image forming apparatus according to the first exemplary embodiment of the present invention, illustrated together with that according to a comparative example.
Figure 2B:
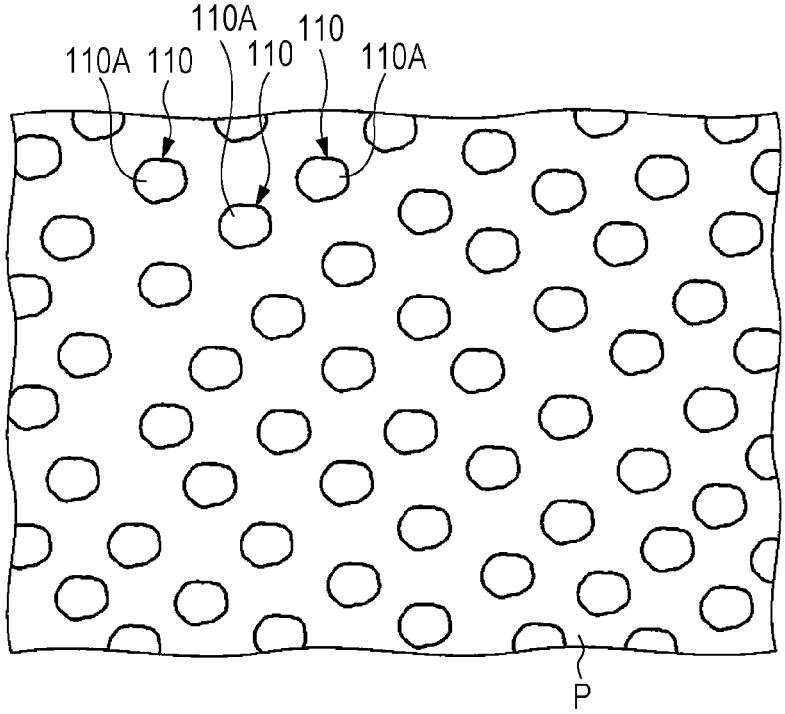

When the pigment particles 110 are disposed evenly on the sheet member P with the reflective surfaces 110A facing in the direction orthogonal to the sheet surface as illustrated in FIG. 2B, meanwhile, the coverage rate, which is the proportion of the sheet member P covered by the pigment particles 110, is improved compared to a case where the pigment particles 110 are disposed on the sheet member P with the reflective surfaces 110A not facing in a uniform direction as illustrated in FIG. 2A. In other words, light that is input from the surface of the sheet member P is reflected by the pigment particles 110 over a large reflective area. This also improves the flop index value.

<Conclusion from Principal Portion>

As is found from the evaluation results described above, if the controller 70 increases the quantity of heat to be applied to the toner image during fixation in the case where a metallic luster is to be imparted to at least a part of an image compared to a case where a metallic luster is not imparted to an image, the pigment particles 110 are brought into a posture in which the reflective surfaces 110A of the pigment particles 110 extend along the sheet surface of the sheet member P.

When the pigment particles 110 are brought into a posture in which the reflective surfaces 110A of the pigment particles 110 extend along the sheet surface of the sheet member P, the flop index value is improved.

Second Exemplary Embodiment

Next, an image forming apparatus according to a second exemplary embodiment of the present invention will be described with reference to FIGS. 9 and 10. Components that are the same as those according to the first exemplary embodiment are denoted by the same reference symbols to omit description thereof, and components that are different from those according to the first exemplary embodiment will be principally described.

In the second exemplary embodiment, the storage elastic modulus G' of the toner of the developer G used by the developing device 24 to develop the electrostatic latent image on the photosensitive drum 21 is varied between the silver toner and the toners in the other colors.

Specifically, the storage elastic modulus G' of the toners in the other colors at the fixing temperature under the luster fixing conditions is set to be higher than the storage elastic modulus G' of the silver toner at the fixing temperature.

The storage elastic modulus G' of a toner indicates the real part of a complex shear elastic modulus G* at a measurement temperature T [° C.]. Specifically, the storage elastic modulus G' of a toner is a value measured by a viscoelasticity measurement device in accordance with a method prescribed in JIS K 7244-6 "Plastics—Determination of dynamic mechanical properties—Part 6: Shear vibration—Non-resonance method".

The storage elastic modulus G' may be varied by changing the resin used for the binder.

[Color Difference]

Next, the effect obtained by varying the storage elastic modulus G' will be described using the color difference (ΔE) measured on the basis of JIS K 5101.

Figure 9A:
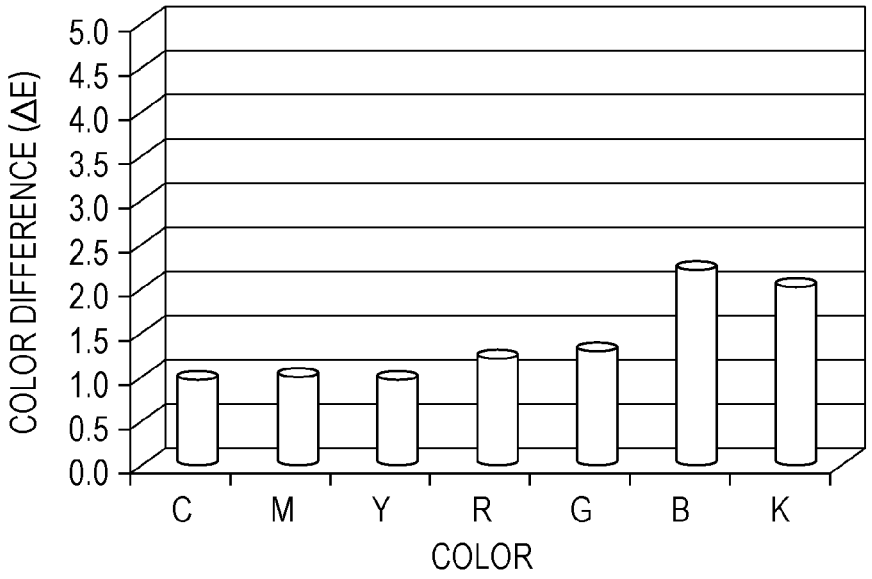
FIGS. 9A and 9B are each a graph used to illustrate a color difference in an image forming apparatus according to a second exemplary embodiment of the present invention.
Figure 9B:
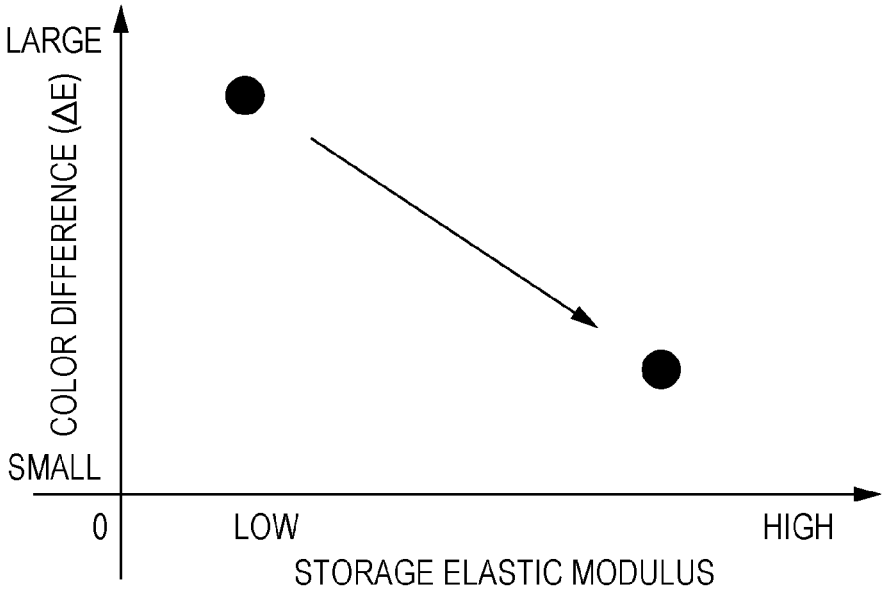

In FIG. 9A, the vertical axis indicates the color difference (ΔE) caused when the toners in the other colors are used. The color differences for red (R), green (G), and blue (B) are indicated for reference only. The color difference for the second special color (W) is not illustrated.

Specifically, the color difference (ΔE) caused in the case where the toners in the other colors are fixed to the OS coated paper W under the luster fixing conditions is indicated with reference to a case where the toners in the other colors are fixed to the OS coated paper W under the standard fixing conditions.

The storage elastic modulus G' of the toners in the other colors at the fixing temperature is set to be generally equal to the storage elastic modulus G' of the silver toner at the fixing temperature.

For the toners in the other colors, as seen from FIG. 9A, the color tint is varied to cause a color difference (ΔE) by changing the fixing conditions from the standard fixing conditions to the luster fixing conditions, that is, by increasing the quantity of heat to be applied to the toner image during fixation. This is because increasing the quantity of heat to be applied to the toner image during fixation softens the binder in the toners in the other colors to facilitate the flow of the toners in the other colors, which changes the surface shape (such as roughness) of the image and hence the light reflected by the image to vary the color tint.

However, in the second exemplary embodiment, as discussed earlier, the storage elastic modulus G' of the toners in the other colors at the fixing temperature is set to be higher than the storage elastic modulus G' of the silver toner at the fixing temperature. That is, it is difficult for the toners in the other colors during fixation to flow compared to the silver toner during fixation. Increasing the storage elastic modulus G of the toners in the other colors during fixation makes it difficult for the toners in the other colors to flow, which reduces the color difference (ΔE) discussed earlier as seen from the graph of FIG. 9B.

That is, the color tint is reproduced appropriately by increasing the storage elastic modulus G' of the toners in the other colors at the fixing temperature compared to the storage elastic modulus G' of the silver toner at the fixing temperature.

[Gloss]

Next, the effect obtained by varying the storage elastic modulus G' will be described using gloss.

Figure 10A:
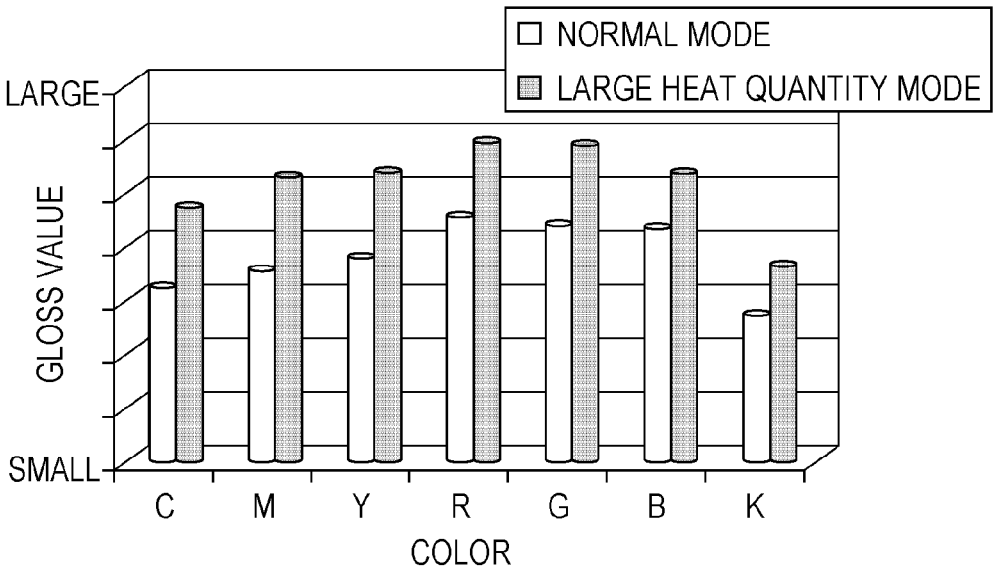
FIGS. 10A and 10B are each a graph used to illustrate gloss in the image forming apparatus according to the second exemplary embodiment of the present invention.
Figure 10B:
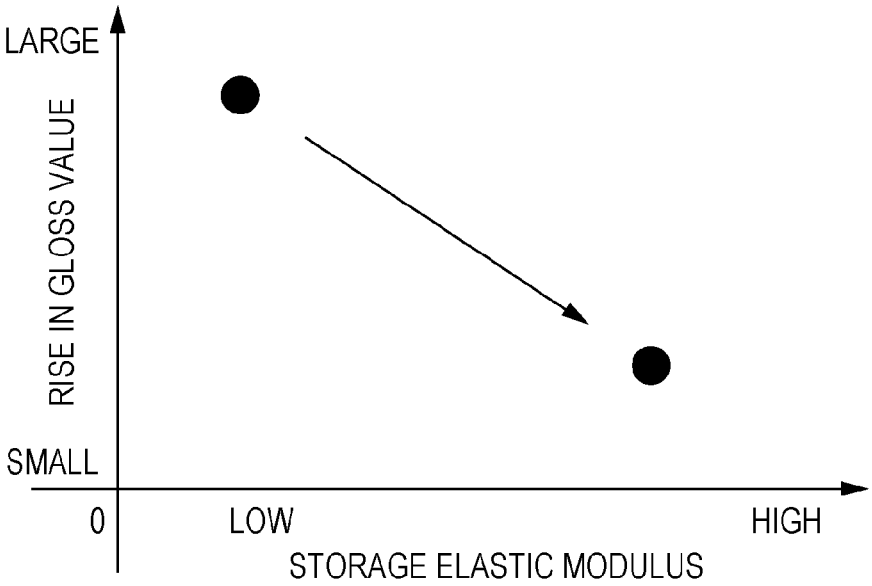

In the graph of FIG. 10A, the vertical axis indicates the gloss value (specular gloss at an angle of 60 degrees defined in accordance with JIS-Z-8741) obtained using the toners in the other colors. The gloss values for red (R), green (G), and blue (B) are indicated for reference only. The gloss value for the second special color (W) is not illustrated.

Specifically, the gloss value obtained in the case where the toners in the other colors are fixed to the OS coated paper W under the standard fixing conditions and the gloss value obtained in the case where the toners in the other colors are fixed to the OS coated paper W under the luster fixing conditions are indicated. The storage elastic modulus G' of the toners in the other colors at the fixing temperature is set to be generally equal to the storage elastic modulus G' of the silver toner at the fixing temperature.

For the toners in the other colors, as seen from FIG. 10A, the gloss value is varied by changing the fixing conditions from the standard fixing conditions to the luster fixing conditions, that is, by increasing the quantity of heat to be applied to the toner image during fixation.

Specifically, the gloss value under the luster fixing conditions is raised compared to the gloss value under the standard fixing conditions. This is because increasing the quantity of heat to be applied to the toner image during fixation softens the binder in the toners in the other colors to facilitate the flow of the toners in the other colors, which changes the surface shape (such as roughness) of the image and hence the light reflected by the image.

However, in the second exemplary embodiment, as discussed earlier, the storage elastic modulus G' of the toners in the other colors at the fixing temperature is set to be higher than the storage elastic modulus G' of the silver toner at the fixing temperature. That is, it is difficult for the toners in the other colors during fixation to flow compared to the silver toner during fixation. Increasing the storage elastic modulus G of the toners in the other colors during fixation makes it difficult for the toners in the other colors to flow, which reduces a rise in gloss value as seen from the graph of FIG. 10B.

That is, the luster is reproduced appropriately by increasing the storage elastic modulus G' of the toners in the other colors at the fixing temperature compared to the storage elastic modulus G' of the silver toner at the fixing temperature.

[Conclusion]

As described above using the color difference (ΔE) and the gloss value, the color tint is reproduced appropriately and the luster is reproduced appropriately by increasing the storage elastic modulus G' of the toners in the other colors at the fixing temperature compared to the storage elastic modulus G' of the silver toner at the fixing temperature.

The other effects are the same as the effects of the first exemplary embodiment.

Third Exemplary Embodiment

Next, an image forming apparatus according to a third exemplary embodiment of the present invention will be described with reference to FIGS. 11 to 14. Components that are the same as those according to the first exemplary embodiment are denoted by the same reference symbols to omit description thereof, and components that are different from those according to the first exemplary embodiment will be principally described.

Figure 14:
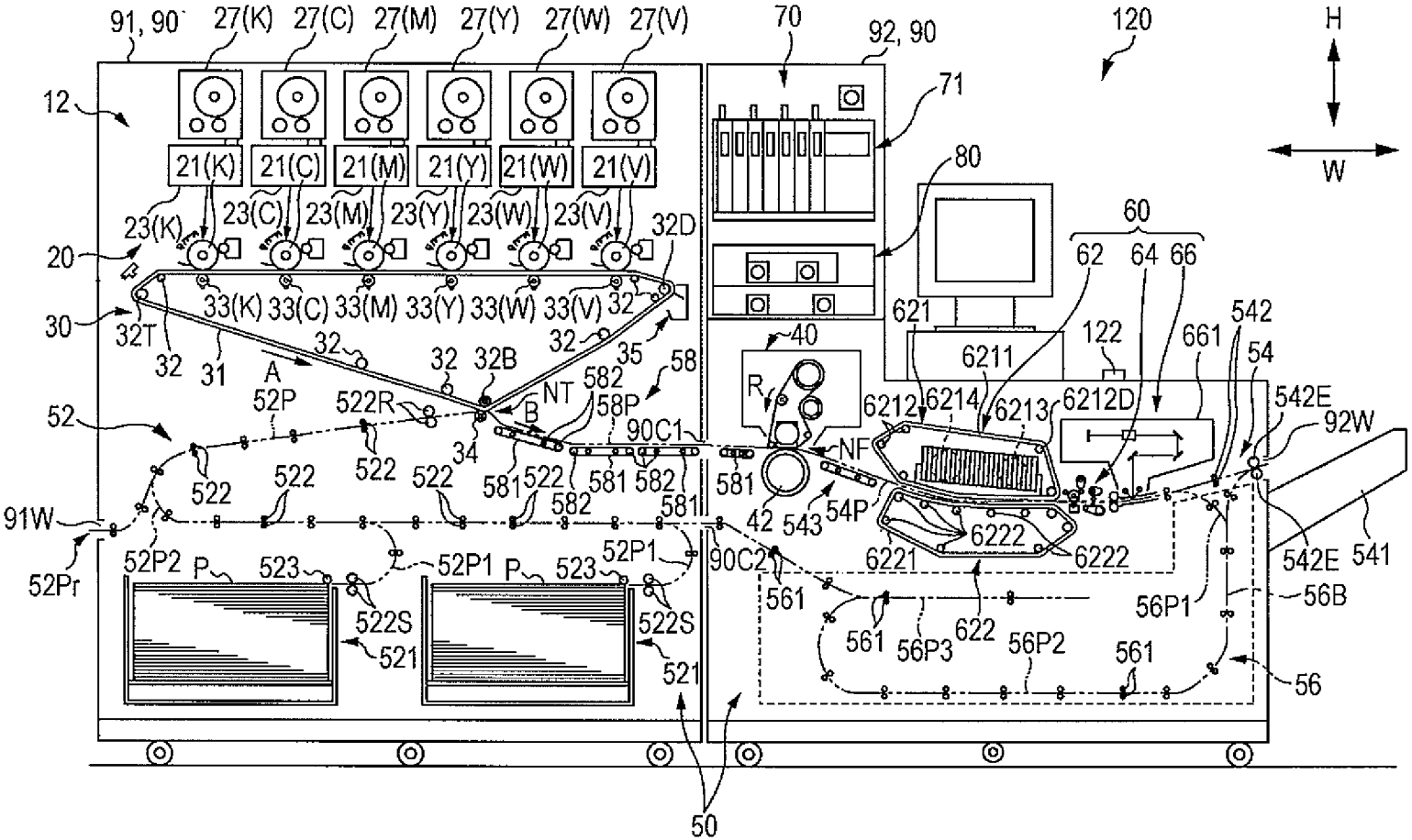
FIG. 14 illustrates a schematic configuration of the image forming apparatus according to the third exemplary embodiment of the present invention.

An image forming apparatus 120 according to the third exemplary embodiment includes a select screen 122 that allows selecting whether the sheet member P on which an image is to be formed is coated paper or regular paper. Specifically, as illustrated in FIG. 14, the select screen 122 is disposed on a lower portion of the upper surface of the housing 92. A text indicating "coated paper" and a text indicating "regular paper" are displayed on the select screen 122 to allow an operator to select one of the texts. In the case where the operator makes no selection, the "regular paper" is to be selected.

(Control Performed when Coated Paper is Selected)

In the case where the "coated paper" is selected using the select screen 122 and an image forming instruction is received to impart a metallic luster to at least a part of an image, the controller 70 sets the toner mass per area (TMA) for the other colors to be small compared to a case where an image forming instruction is received not to impart a metallic luster to an image.

The TMA indicates the mass per unit area [g/m$^2$] of the toner transferred to the sheet member P. The TMA is obtained by measuring the mass of a toner collected from a patch of a predetermined size through suctioning before the toner image is fixed to the sheet member P.

The coated paper is paper prepared by applying a paint, a synthetic resin, or the like to base paper in order to impart a luster to the sheet surface. Examples of the coated paper include the OS coated paper W (manufactured by Fuji Xerox InterField Co., Ltd. and having a basis weight of 127 [g/m$^2$] and a smoothness measured in accordance with JISP 8119 of 4735 [Sec]) discussed earlier.

[Effect Achieved when Coated Paper is Selected]

Next, the effect obtained by varying the TMA when the coated paper is selected will be described.

Figure 11A:
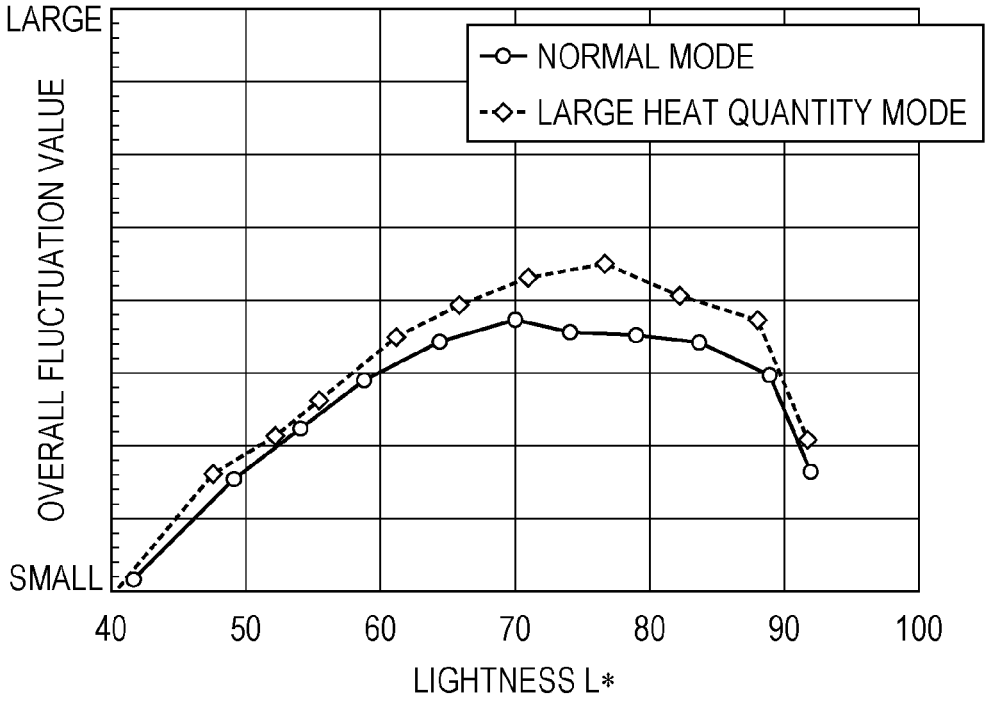
FIGS. 11A and 11B are each a graph used to illustrate an overall fluctuation value of an image in an image forming apparatus according to a third exemplary embodiment of the present invention.
Figure 11B:
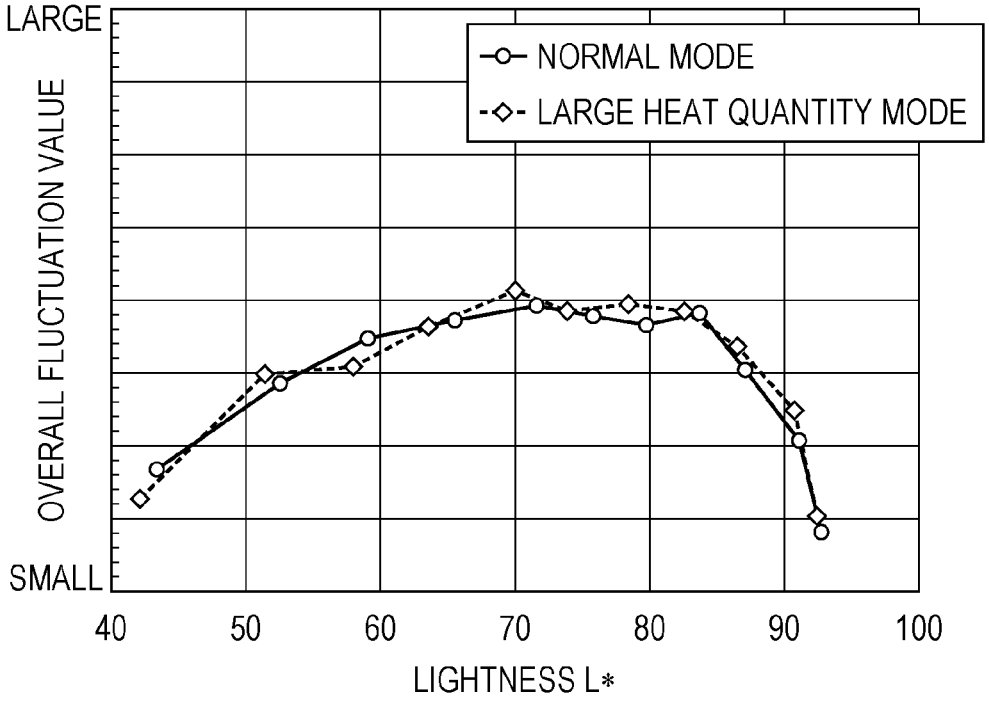

In the graphs of FIGS. 11A and 11B, the vertical axis indicates the overall fluctuation value (granularity) of the color tint, and the horizontal axis indicates the lightness L* measured in accordance with JIS 28729.

The overall fluctuation value is obtained by measuring the lightness L*, the hue a*, and the hue b* in accordance with JIS 28729, and digitalizing minute non-uniformities in color tint on the basis of the measured values. That is, a larger overall fluctuation value indicates greater non-uniformities than those indicated by a smaller overall fluctuation value.

Meanwhile, a larger value of the lightness L* indicates a thinner color than that indicated by a smaller value of the lightness L*.

FIG. 11A illustrates the overall fluctuation value (the solid line in the drawing) for a case where a toner with a TMA of 4.5 [g/m$^2$] is fixed to the OS coated paper W under the standard fixing conditions, and the overall fluctuation value (the dotted line in the drawing) for a case where a toner with a TMA of 4.5 [g/m$^2$] is fixed to the OS coated paper W under the luster fixing conditions.

In contrast, FIG. 11B illustrates the overall fluctuation value (the solid line in the drawing) for a case where a toner with a TMA of 4.0 [g/m$^2$] is fixed to the OS coated paper W under the standard fixing conditions, and the overall fluctuation value (the dotted line in the drawing) for a case where a toner with a TMA of 4.0 [g/m$^2$] is fixed to the OS coated paper W under the luster fixing conditions.

For the toner with a TMA of 4.5 [g/m$^2$], as seen from FIG. 11A, the overall fluctuation value is increased by changing the fixing conditions from the standard fixing conditions to the luster fixing conditions, that is, by increasing the quantity of heat to be applied to the toner image during fixation. The overall fluctuation value is particularly increased when the lightness L* is in the range of 60 to 90. This is because increasing the quantity of heat to be applied to the toner image during fixation softens the binder in the toner to facilitate the flow of the toners in the other colors.

The factor that increases the overall fluctuation value will be specifically described below.

Figure 12A:
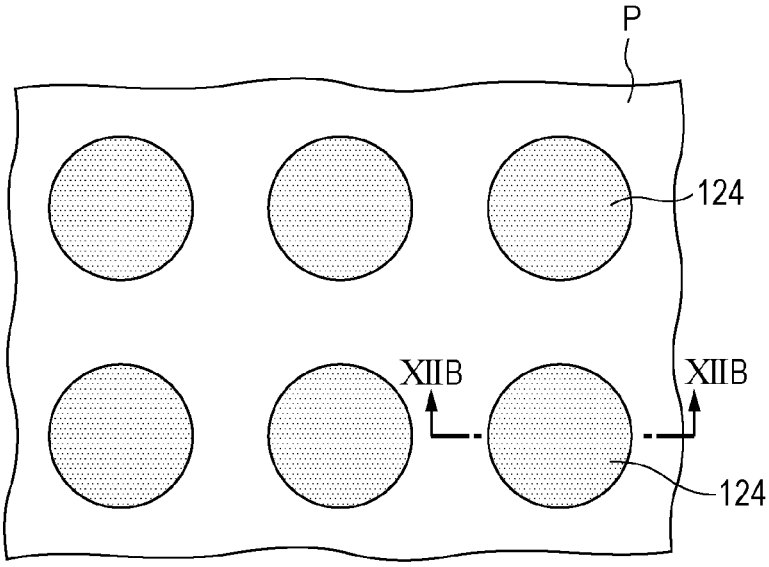
FIGS. 12A to 12D are used to illustrate the shape of a toner fixed to a sheet member in the image forming apparatus according to the third exemplary embodiment of the present invention.
Figure 12B:
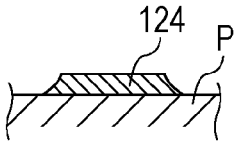

FIGS. 12A and 12B are a plan view and a cross-sectional view, respectively, of a toner 124 with a TMA of 4.5 [g/m$^2$] fixed to the coated paper (the OS coated paper W) under the standard fixing conditions. In this case, the cross section of the toner 124 is symmetric in the horizontal direction in the drawings.

Figure 12C:
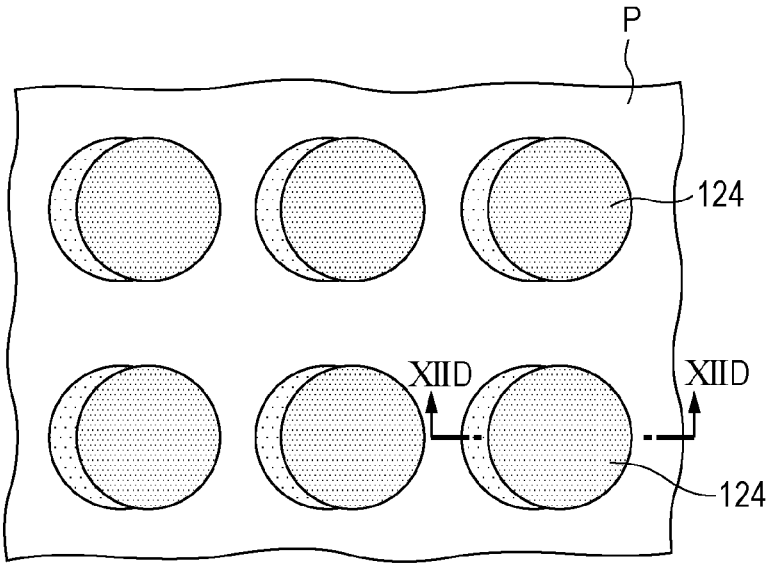
Figure 12D:
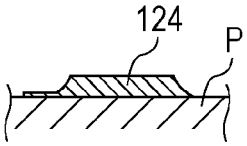

In contrast, FIGS. 12C and 12D are a plan view and a cross-sectional view, respectively, of the toner 124 with a TMA of 4.5 [g/m$^2$] fixed to the coated paper (the OS coated paper W) under the luster fixing conditions. In this case, the cross section of the toner 124 is not symmetric in the horizontal direction in the drawings, and so-called image deviation is caused on one side (on the left side in the drawings). Such image deviation is caused because the flow of the toner is facilitated to cause a part of the toner 124 to flow to one side. This tendency is particularly conspicuous for the coated paper, the smoothness of which is higher than the regular paper.

It is considered that changing the fixing conditions from the standard fixing conditions to the luster fixing conditions causes the image deviation to increase the overall fluctuation value.

For the toner with a TMA of 4.0 [g/m$^2$], in contrast, as seen from FIG. 11B, the overall fluctuation value is not increased by changing the fixing conditions from the standard fixing conditions to the luster fixing conditions, that is, by increasing the quantity of heat to be applied to the toner image during fixation, unlike for the toner with a TMA of 4.5 [g/m$^2$].

The reason that the overall fluctuation value is not increased by changing the fixing conditions from the standard fixing conditions to the luster fixing conditions for a toner with a small TMA will be specifically described below.

Figure 13A:
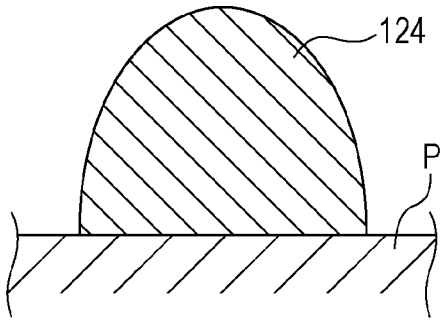
FIGS. 13A and 13B are used to illustrate the shape of the toner transferred to the sheet member in the image forming apparatus according to the third exemplary embodiment of the present invention.
Figure 13B:
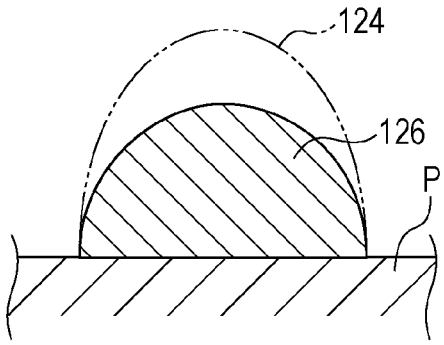

FIG. 13A illustrates a cross section of the toner 124 with a TMA of 4.5 [g/m$^2$] before fixation. FIG. 13B illustrates a cross section of a toner 126 with a TMA of 4.0 [g/m$^2$] before fixation. As discussed earlier, the height of the toner 126 with a TMA of 4.0 [g/m$^2$] is smaller than the height of the toner 124 with a TMA of 4.5 [g/m$^2$] because of the difference in TMA. That is, the difference in TMA causes a difference in height of the toners.

Consequently, the toner 126 is prevented from partially flowing to one side even if the flow of the toner is facilitated by changing the fixing conditions to the luster fixing conditions. Therefore, for the toner with a TMA of 4.0 [g/m$^2$], the overall fluctuation value is not increased by changing the fixing conditions from the standard fixing conditions to the luster fixing conditions, unlike for the toner with a TMA of 4.5 [g/m$^2$]. In other words, the overall fluctuation value is not increased by changing the fixing conditions from the standard fixing conditions to the luster fixing conditions when the TMA is small, compared to a case where the TMA is not small, in the case where the coated paper is used.

As discussed earlier, in the case where the "coated paper" is selected using the select screen 122 and an image forming instruction is received to impart a metallic luster to at least a part of an image, the controller 70 sets the TMA for the other colors to be small compared to a case where an image forming instruction is received not to impart a metallic luster to an image.

Therefore, the overall fluctuation value is not increased by changing the fixing conditions from the standard fixing conditions to the luster fixing conditions. This suppresses non-uniformities in color tint.

The other effects are the same as those of the first exemplary embodiment.

Fourth Exemplary Embodiment

Next, an image forming apparatus according to a fourth exemplary embodiment of the present invention will be described with reference to FIGS. 15 to 17. Components that are the same as those according to the first exemplary embodiment are denoted by the same reference symbols to omit description thereof, and components that are different from those according to the first exemplary embodiment will be principally described.

As in the third exemplary embodiment, an image forming apparatus 120 according to the fourth exemplary embodiment includes a select screen 122 that allows selecting whether the sheet member P on which an image is to be formed is coated paper or regular paper. In the case where the operator makes no selection, the "regular paper" is to be selected.

(Control Performed when Regular Paper is Selected)

In the case where the "regular paper" is selected using the select screen 122 and an image forming instruction is received to impart a metallic luster to at least a part of an image, the controller 70 sets the TMA for the other colors to be large compared to a case where an image forming instruction is received not to impart a metallic luster to an image.

The regular paper is paper used for regular printing. Examples of the regular paper include the J paper (manufactured by Fuji Xerox InterField Co., Ltd. and having a basis weight of 82 [g/m$^2$] and a smoothness measured in accordance with JISP 8119 of 112 [Sec]) discussed earlier.

[Effect Achieved when Regular Paper is Selected]

Next, the effect obtained by varying the TMA when the regular paper is selected will be described.

Figure 15A:
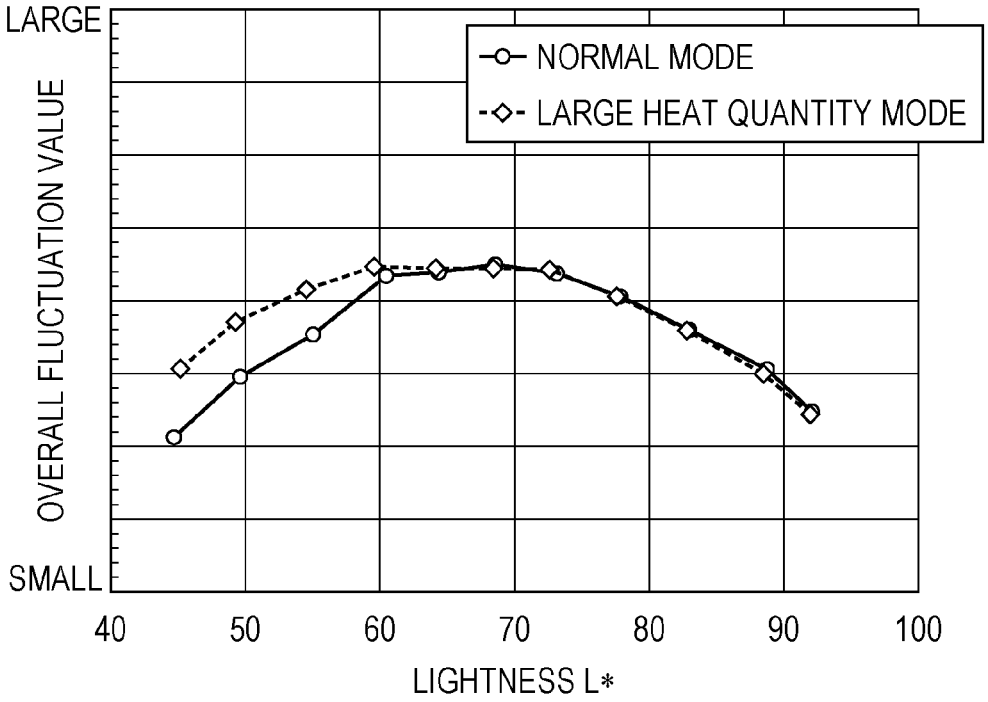
FIGS. 15A and 15B are each a graph used to illustrate an overall fluctuation value of an image in an image forming apparatus according to a fourth exemplary embodiment of the present invention.
Figure 15B:
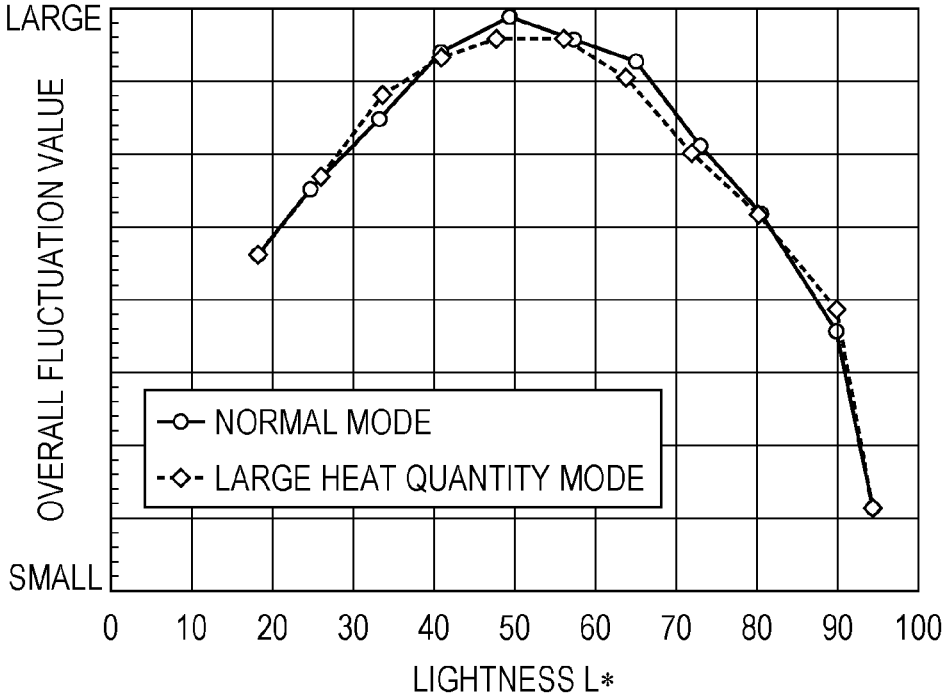

In the graphs of FIGS. 15A and 15B, the vertical axis indicates the overall fluctuation value (granularity) of the color tint, and the horizontal axis indicates the lightness L* measured in accordance with JIS 28729.

FIG. 15A illustrates the overall fluctuation value (the solid line in the drawing) for a case where a toner with a TMA of 4.8 [g/m$^2$] is fixed to the J paper under the standard fixing conditions, and the overall fluctuation value (the dotted line in the drawing) for a case where a toner with a TMA of 4.8 [g/m$^2$] is fixed to the J paper under the luster fixing conditions.

In contrast, FIG. 15B illustrates the overall fluctuation value (the solid line in the drawing) for a case where a toner with a TMA of 5.3 [g/m$^2$] is fixed to the J paper under the standard fixing conditions, and the overall fluctuation value (the dotted line in the drawing) for a case where a toner with a TMA of 5.3 [g/m$^2$] is fixed to the J paper under the luster fixing conditions.

For the toner with a TMA of 4.8 [g/m$^2$], as seen from FIG. 15A, the overall fluctuation value is increased by changing the fixing conditions from the standard fixing conditions to the luster fixing conditions, that is, by increasing the quantity of heat to be applied to the toner image during fixation. The overall fluctuation value is particularly increased when the lightness L* is in the range of 45 to 60. This is because increasing the quantity of heat to be applied to the toner image during fixation softens the binder in the toner to facilitate penetration of the toner into the J paper.

The factor that increases the overall fluctuation value by increasing the quantity of heat to be applied to the toner image during fixation will be specifically described below.

Figure 16A:
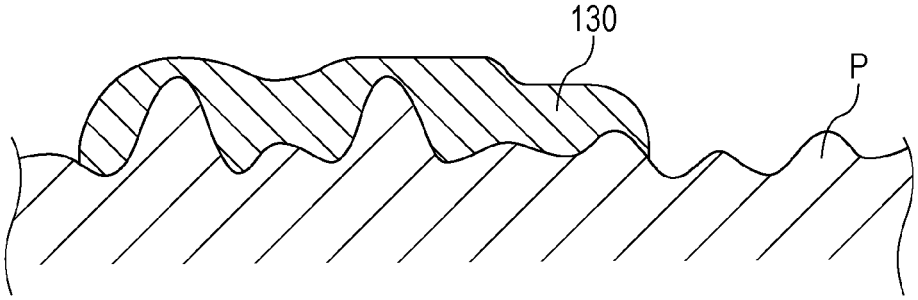
FIGS. 16A and 16B are each a cross-sectional view illustrating a toner transferred to a sheet member P and the toner fixed to the sheet member P, respectively, in a comparative example of the image forming apparatus according to the fourth exemplary embodiment of the present invention.
Figure 16B:
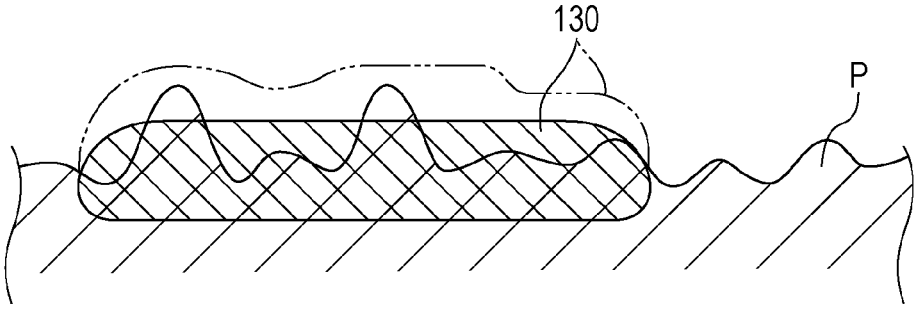

FIG. 16A illustrates a cross section of a toner 130 with a TMA of 4.8 [g/m$^2$] before fixation. FIG. 16B illustrates a cross section of the toner 130 with a TMA of 4.8 [g/m$^2$] after fixation under the luster fixing conditions.

The smoothness of the J paper (regular paper) is lower than the smoothness of the coated paper. The surface of the J paper is more uneven than that of the coated paper. With the binder softened by changing the fixing conditions from the standard fixing conditions to the luster fixing conditions, the toner 130 with a TMA of 4.8 [g/m$^2$] easily penetrates the J paper. Therefore, as illustrated in FIG. 16B, with the toner 130 with a TMA of 4.8 [g/m$^2$] penetrating the J paper and fixed to the J paper, a part of the surface of the J paper which is uneven is exposed. Therefore, the overall fluctuation value is increased by increasing the quantity of heat to be applied to the toner image during fixation.

For the toner with a TMA of 5.3 [g/m$^2$], in contrast, as seen from FIG. 15B, the overall fluctuation value is not increased by changing the fixing conditions from the standard fixing conditions to the luster fixing conditions, that is, by increasing the quantity of heat to be applied to the toner image during fixation, unlike for the toner with a TMA of 4.8 [g/m$^2$]. This is because of the difference in TMA.

In other words, the overall fluctuation value is not increased by changing the fixing conditions from the standard fixing conditions to the luster fixing conditions when the TMA is large in the case where the J paper is used.

The reason that the overall fluctuation value is not increased by increasing the quantity of heat to be applied to the toner image during fixation when the TMA is large in the case where the J paper is used will be specifically described below.

Figure 17A:
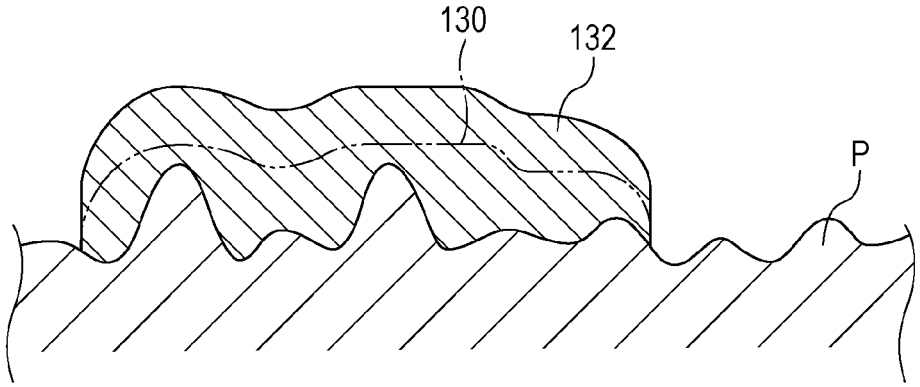
FIGS. 17A and 17B are each a cross-sectional view illustrating a toner transferred to a sheet member P and the toner fixed to the sheet member P, respectively, in the image forming apparatus according to the fourth exemplary embodiment of the present invention.
Figure 17B:
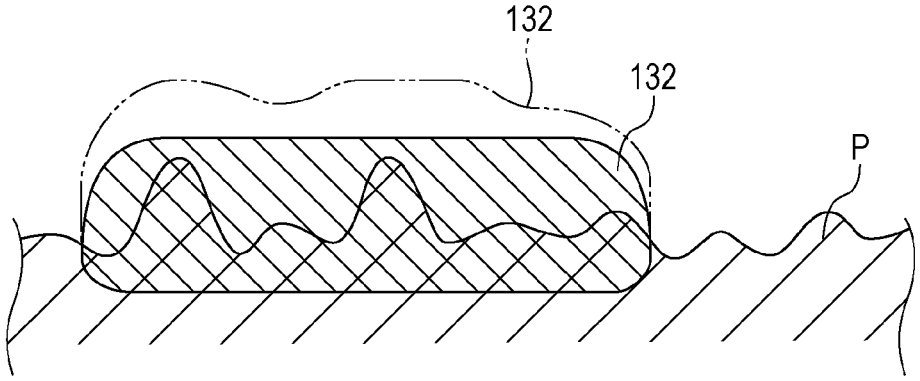

FIG. 17A illustrates a cross section of a toner 132 with a TMA of 5.3 [g/m$^2$] before fixation. FIG. 17B illustrates a cross section of the toner 132 with a TMA of 5.3 [g/m$^2$] after fixation under the luster fixing conditions.

As discussed earlier, the height of the toner 132 with a TMA of 5.3 [g/m$^2$] is larger than the height of the toner 130 with a TMA of 4.8 [g/m$^2$] as illustrated in FIG. 17A because of the difference in TMA. Therefore, as illustrated in FIG. 17B, with the toner 132 with a TMA of 5.3 [g/m$^2$] penetrating the J paper and fixed to the J paper, the surface of the J paper which is uneven is not exposed. Consequently, the overall fluctuation value is not increased by increasing the quantity of heat to be applied to the toner image during fixation when the TMA is large in the case where the J paper is used.

In the case where the "regular paper" is selected using the select screen 122 and an image forming instruction is received to impart a metallic luster to at least a part of an image, as discussed earlier, the controller 70 sets the TMA for the other colors to be large compared to a case where an image forming instruction is received not to impart a metallic luster to an image.

Therefore, the overall fluctuation value is not increased by increasing the quantity of heat to be applied to the toner image during fixation. This suppresses non-uniformities in color tint.

The other effects are the same as those of the first exemplary embodiment.

Fifth Exemplary Embodiment

Next, an image forming apparatus according to a fifth exemplary embodiment of the present invention will be described with reference to FIG. 18. Components that are the same as those according to the first exemplary embodiment are denoted by the same reference symbols to omit description thereof, and components that are different from those according to the first exemplary embodiment will be principally described.

Figure 18:
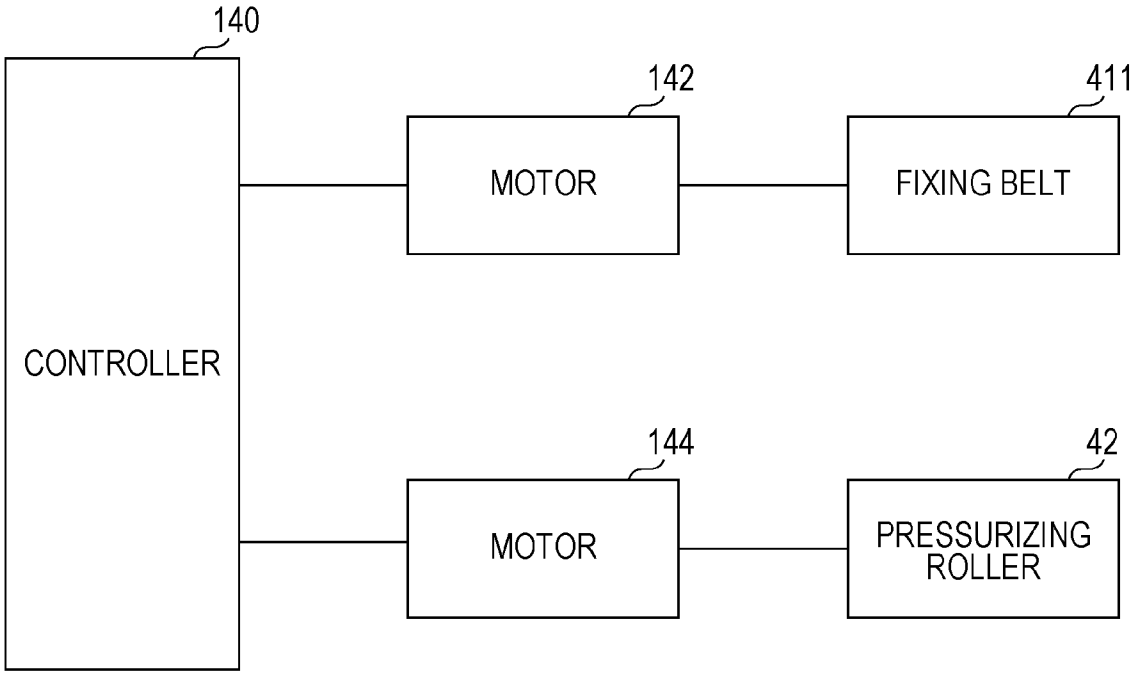
FIG. 18 is a block diagram illustrating the control system of a controller provided in an image forming apparatus according to a fifth exemplary embodiment of the present invention.

In the case where a controller 140 receives an image forming instruction to impart a metallic luster to at least a part of an image, the controller 140 controls a motor 142 that applies a drive force to the fixing belt 411 and a motor 144 that applies a drive force to the pressurizing roller 42 as illustrated in FIG. 18 so as to provide a difference between the peripheral velocity of the fixing belt 411 and the peripheral velocity of the pressurizing roller 42.

This applies a shearing force in the transport direction of the sheet member P to the toner of the toner image to be fixed to the sheet member P, which causes the pigment particles 110 to be arranged in the direction along the sheet surface with the reflective surfaces 110A facing in the direction orthogonal to the sheet surface of the sheet member P (see FIG. 1B).

This effectively brings the pigment particles 110 into a posture in which the reflective surfaces 110A of the pigment particles 110 extend along the sheet surface of the sheet member P.

The other effects are the same as those of the first exemplary embodiment.

While specific exemplary embodiments of the present invention have been described in detail above, the present invention is not limited to such exemplary embodiments. It is apparent to those skilled in the art that a variety of other exemplary embodiments may fall within the scope of the present invention. For example, the toner images in the respective colors are transferred to the transfer belt 31 in the exemplary embodiments described above. However, the toner images in the respective colors may be directly transferred to the sheet member P, and the toner images in the respective colors may be collectively transferred to the transfer belt 31 or the sheet member P, and the silver toner image and the toner images in the other colors may be fixed to the sheet member P at the same time.

The exemplary embodiments described above are merely illustrative, and the present invention is not limited thereto. The present invention may be subjected to modifications, deletions, additions, and combinations without departing from the technical scope of the present invention that may be recognized by those skilled in the art from the claims, the specification, and the drawings. Specifically, the first to fourth exemplary embodiments may be combined, for example.

What is claimed is:

1. An image forming apparatus comprising:

a first image forming section configured to use a toner containing a binder resin and flat pigment particles;

a second image forming section configured to use a toner containing a binder resin but not containing the flat pigment particles;

a transfer section configured to transfer a toner image onto a recording medium; and a fixing section configured to fix the toner image to the recording medium by heating the toner image to soften the binder resin in the toner of the toner image to change a position of the flat pigment particles within the toner, wherein the fixing section is configured to fix an image to the recording medium while transporting the recording medium, wherein the transfer section or the fixing section is configured to, in a case where an image has been formed on the recording medium using the toner containing the flat pigment particles, apply a shearing force in a transport direction of the recording medium to the image, wherein a thickness of the binder resin on the recording medium after fixing by the fixing section is shorter than a length of a major axis of the flat pigment particles, and wherein the transfer section or the fixing section is configured to, in a case where no image has been formed on the recording medium using the toner containing the flat pigment particles, refrain from applying the shearing force in the transport direction of the recording medium to the image.

2. An image forming apparatus comprising:

a controller;

a first image forming section configured to use a toner containing a binder resin and flat pigment particles;

a second image forming section configured to use a toner containing a binder resin but not containing the flat pigment particles;

a transfer section configured to transfer a toner image onto a recording medium; and a fixing section configured to fix the toner image to the recording medium by heating the toner image to soften the binder resin in the toner of the toner image to change a position of the flat pigment particles within the toner, wherein the controller is configured to, in a case where an image has been formed on the recording medium using the toner containing the flat pigment particles, control a driving member to provide a difference between a peripheral velocity of a fixing member and a peripheral velocity of a pressurizing member so as to apply a shearing force in a transport direction of the recording medium to the toner of the toner image to be fixed to the recording medium, thereby causing the flat pigment particles to be arranged in a direction extending along a surface of the recording medium with reflective surfaces of the flat pigment particles facing in a direction orthogonal to the surface of the recording medium, wherein a thickness of the binder resin on the recording medium after fixing by the fixing section is shorter than a length of a major axis of the flat pigment particles, and wherein the controller is configured to, in a case where no image has been formed on the recording medium using the toner containing the flat pigment particles, control the driving member to refrain from providing the difference between the peripheral velocity of the fixing member and the peripheral velocity of the pressurizing member so as to refrain from applying the shearing force in the transport direction of the recording medium to the toner of the toner image to be fixed to the recording medium.

* * * * *